US010830503B2

(12) United States Patent
Kopko

(10) Patent No.: US 10,830,503 B2
(45) Date of Patent: Nov. 10, 2020

(54) HEAT PUMP SYSTEM WITH MULTIPLE OPERATING MODES

(71) Applicant: Johnson Controls Technology Company, Auburn Hills, MI (US)

(72) Inventor: William L. Kopko, Jacobus, PA (US)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

(21) Appl. No.: 16/433,840

(22) Filed: Jun. 6, 2019

(65) Prior Publication Data

US 2019/0285318 A1 Sep. 19, 2019

Related U.S. Application Data

(63) Continuation of application No. 14/674,811, filed on Mar. 31, 2015, now Pat. No. 10,317,112.
(Continued)

(51) Int. Cl.
*F25B 13/00* (2006.01)
*F25B 5/02* (2006.01)
(Continued)

(52) U.S. Cl.
CPC ..... *F25B 13/00* (2013.01); *F25B 5/02* (2013.01); *F25B 40/00* (2013.01); *F25B 41/003* (2013.01);
(Continued)

(58) Field of Classification Search
CPC .. F25B 30/02; F25B 41/043; F25B 2313/009; F25B 2313/021; F25B 2313/0211;
(Continued)

(56) References Cited

U.S. PATENT DOCUMENTS 3,909,670 A 9/1975 Wakamatsu et al.
7,469,554 B2 12/2008 Martins et al.
(Continued)

FOREIGN PATENT DOCUMENTS

CN 1059399 A 3/1992
CN 1403768 A 3/2003
(Continued)

OTHER PUBLICATIONS

York International, "AWHP Energypak, Multi-Mode Heat Pump, Installation, Commissioning, Operation and Maintenance," Jun. 1999, 55 pgs. (Year: 1999).*
(Continued)

*Primary Examiner* — Steve S Tanenbaum
(74) *Attorney, Agent, or Firm* — Fletcher Yoder, P.C.

(57) ABSTRACT

The present disclosure relates to a refrigeration system that includes an evaporator disposed along an evaporator line, a compressor system disposed along a compressor line, a condenser disposed along a condenser line and configured to condense the refrigerant compressed by the compressor system to heat a second fluid stream, and an outdoor coil disposed along a coil line and configured to receive the refrigerant from the condenser or from a discharge line, to selectively transfer heat to or from the refrigerant, and to selectively transfer the refrigerant to the evaporator or to a suction line. The refrigeration system includes two valves and three expansion valves disposed along the different refrigerant flow lines, and a controller configured to determine a simultaneous heating/cooling operating mode of the refrigeration system and to control the valves and expansion valves to operate the refrigeration system in the desired mode.

10 Claims, 11 Drawing Sheets

Related U.S. Application Data

(60) Provisional application No. 61/975,403, filed on Apr. 4, 2014.

(51) Int. Cl.

| | |
|---|---|
| ***F25B 40/00*** | (2006.01) |
| ***F25B 41/00*** | (2006.01) |
| ***F25B 41/04*** | (2006.01) |
| ***F25B 49/02*** | (2006.01) |

(52) U.S. Cl.

CPC ..... *F25B 41/04* (2013.01); *F25B 49/02* (2013.01); *F25B 2341/0662* (2013.01); *F25B 2400/0403* (2013.01); *F25B 2400/0409* (2013.01); *F25B 2400/054* (2013.01); *F25B 2400/13* (2013.01); *F25B 2400/23* (2013.01); *F25B 2600/0261* (2013.01); *F25B 2600/2509* (2013.01)

(58) Field of Classification Search

CPC ..... F25B 2313/0212; F25B 2313/0213; F25B 6/04; F25B 2339/04; F25B 2339/043; F25B 2339/044; F25B 2339/0446; F25B 2339/047; F25B 2339/045; F25B 13/00; F25B 5/02; F25B 40/00; F25B 41/003; F25B 41/04; F25B 49/02; F25B 2400/23; F25B 2341/0662; F25B 2400/0403; F25B 2400/0409; F25B 2400/054; F25B 2400/13; F25B 2600/0261; F25B 2600/2509; F28D 1/0408; F28D 1/0417; F28D 1/0426; F28D 9/0093; F28F 2250/104; F28F 2250/106; F28F 2250/108; F28F 2255/00; F28F 3/086

USPC ..... 62/115

See application file for complete search history.

(56) References Cited

U.S. PATENT DOCUMENTS

| | | | | |
|---|---|---|---|---|
| 2011/0036113 | A1* | 2/2011 | Kopko ..... | F25B 30/02 62/324.5 |
| 2013/0146265 | A1 | 6/2013 | Kim | |
| 2015/0226469 | A1 | 8/2015 | Hofmann et al. | |

FOREIGN PATENT DOCUMENTS

| | | | |
|---|---|---|---|
| CN | 102216700 | A | 10/2011 |
| DE | 102006024796 | A1 | 9/2007 |
| EP | 0473286 | A2 | 3/1992 |
| EP | 0783093 | A2 | 7/1997 |
| EP | 1348920 | A2 | 10/2003 |
| EP | 2487437 | A1 | 8/2012 |
| FR | 2874265 | A1 | 2/2006 |
| FR | 2886388 | A1 | 12/2006 |
| KR | 100788459 | B1 | 12/2007 |
| WO | 2006118573 | A1 | 11/2006 |
| WO | 2014044522 | A1 | 3/2014 |

OTHER PUBLICATIONS

York International, "AWHP Energypak, Multi-Mode Heat Pump, Installation, Commissioning, Operation and Maintenance," Jun. 1999, 55 pgs.

Hofmann, Herbert, et. al., Condenser, Mar. 2014, European Patent Office, English Translation.

* cited by examiner

HEAT PUMP SYSTEM WITH MULTIPLE OPERATING MODES

CROSS-REFERENCE TO RELATED APPLICATIONS

This application is a continuation of U.S. patent application Ser. No. 14/674,811, filed on Mar. 31, 2015, and entitled "HEAT PUMP SYSTEM WITH MULTIPLE OPERATING MODES," which claims the benefit of U.S. Provisional Application No. 61/975,403, filed on Apr. 4, 2014, which are incorporated by reference herein in their entireties for all purposes.

BACKGROUND

The present disclosure relates generally to heating, ventilating, air conditioning and refrigeration (HVAC&R) systems and more particularly to heat pump systems with multiple operating modes.

Many applications exist for HVAC&R systems. For example, residential, light commercial, commercial and industrial systems are used to control temperatures and air quality in residences and buildings. These systems generally operate by implementing a thermal cycle in which fluids are heated and cooled to provide the desired temperature in a controlled space, typically the inside of a residence or building. Generally, HVAC&R systems operate by circulating a fluid, such as refrigerant, through a closed loop between a heat exchanger where the fluid is evaporated to absorb heat and a heat exchanger where the fluid condenses to release heat. The fluid flowing within the closed loop is generally formulated to undergo phase changes within the normal operating temperatures and pressures of the system so that considerable quantities of heat can be exchanged by virtue of the latent heat of vaporization of the fluid. Certain HVAC&R systems are designed for specific applications, such as heating alone or cooling alone. Other systems, such as water-to-water heat pumps and reversing air source heat pumps are capable of operating in multiple modes to provide the desired heating, cooling, or other applications. It is now recognized that there is a need for improved HVAC&R systems that provide a variety of heating, cooling, chiller, and heat pump operations.

SUMMARY

The present disclosure relates to a refrigeration system that includes a compressor line, a condenser line coupled to the compressor line via a first junction at a discharge end of the compressor line, and a discharge line coupled to the compressor line via the first junction. The refrigeration system also includes an evaporator line coupled to the compressor line via a second junction at a suction end of the compressor line, a suction line coupled to the compressor line via the second junction, and a coil line. The discharge line and the suction line are coupled to the coil line via a third junction at a first end of the coil line, and the condenser line and the evaporator line are coupled to the coil line via a fourth junction at a second end of the coil line opposite the first end. In addition, the refrigeration system includes an evaporator disposed along the evaporator line and configured to vaporize a refrigerant to cool a first fluid stream, a compressor system disposed along the compressor line and configured to compress the vaporized refrigerant, a condenser disposed along the condenser line and configured to condense the refrigerant compressed by the compressor system to heat a second fluid stream, and an outdoor coil disposed along the coil line and configured to receive the refrigerant from the condenser or from the discharge line, to selectively transfer heat to or from the refrigerant, and to selectively transfer the refrigerant to the evaporator or to the suction line. Further, the refrigeration system includes a first valve disposed along the discharge line, a second valve disposed along the suction line, a first expansion valve disposed along the condenser line between the condenser and the fourth junction, a second expansion valve disposed along the coil line between the coil and the fourth junction, and a third expansion valve disposed along the evaporator line between the fourth junction and the evaporator.

The present disclosure also relates to a refrigeration system including a compressor line, a condenser line coupled to a discharge end of the compressor line, a discharge line coupled to the discharge end of the compressor line, an evaporator line coupled to a suction end of the compressor line, and a suction line coupled to the suction end of the compressor line. The refrigeration system also includes a coil line coupled to the discharge line, the suction line, the condenser line, and the evaporator line. The condenser line and the evaporator line are coupled to the coil line via a first junction at a first end of the coil line. In addition, the refrigeration system includes an evaporator disposed along the evaporator line and configured to vaporize a refrigerant to cool a first fluid stream, a compressor system disposed along the compressor line and configured to compress the vaporized refrigerant, and a condenser disposed along the condenser line and configured to condense the refrigerant compressed by the compressor system to heat a second fluid stream. Further, the refrigeration system includes an outdoor coil disposed along the coil line and configured to receive the refrigerant from the condenser or from the discharge line, to selectively transfer heat to or from the refrigerant, and to selectively transfer the refrigerant to the evaporator or to the suction line. The refrigeration system also includes a first valve disposed along the discharge line and configured to enable or prevent a flow of the compressed refrigerant from the compressor system to the coil and a second valve disposed along the suction line and configured to enable or prevent a flow of the refrigerant from the coil to the compressor system. In addition, the refrigeration system includes a first expansion valve disposed along the condenser line between the condenser and the first junction and configured to enable or prevent a flow of refrigerant through the condenser, a second expansion valve disposed along the coil line between the coil and the first junction and configured to enable or prevent a flow of refrigerant through the coil, and a third expansion valve disposed along the evaporator line between the first junction and the evaporator and configured to enable or prevent a flow of the refrigerant through the evaporator.

Present embodiments also are directed to a method that includes circulating a refrigerant through a refrigeration system. The refrigeration system includes an evaporator disposed along an evaporator line and configured to vaporize a refrigerant to cool a first fluid stream directed to a cooling load via an evaporator pump, a compressor system disposed along a compressor line and configured to compress the vaporized refrigerant, a condenser disposed along a condenser line and configured to condense the refrigerant compressed by the compressor system to heat a second fluid stream directed to a heating load via a condenser pump, and an outdoor coil disposed along a coil line and configured to receive the refrigerant from the condenser or from the compressor system, to selectively transfer heat to or from the refrigerant via ambient air blown over the coil via a fan, and to selectively transfer the refrigerant to the evaporator or to the compressor system. The refrigeration system also includes a first valve disposed along a discharge line and configured to enable or prevent a flow of the compressed refrigerant from the compressor system to the coil, a second valve disposed along a suction line and configured to enable or prevent a flow of the refrigerant from the coil to the compressor system, a first expansion valve disposed along the condenser line on an outlet side of the condenser, a second expansion valve disposed along the coil line and configured to enable or prevent a flow of refrigerant through the coil, and a third expansion valve disposed along the evaporator line on an inlet side of the evaporator. The method also includes determining, via a controller, a mode of operation of the heat pump based at least in part on a heating set point, a cooling set point, a measured temperature of the first fluid stream, a measured temperature of the second fluid stream, and a measured ambient air temperature. In addition, the method includes controlling, via the controller, the first valve, the second valve, the first expansion valve, the second expansion valve, the third expansion valve, the fan, the condenser pump, and the evaporator pump based on the determined mode of operation. The controller is configured to determine the mode of operation to be "cooling only" when the cooling set point is lower than the measured temperature of the first fluid stream and the heating set point is lower than or equal to the measured temperature of the second fluid stream. The controller is configured to determine the mode of operation to be "100% heat recovery" when the cooling set point is approximately a threshold temperature amount below the measured temperature of the first fluid stream and the heating set point is approximately the threshold temperature amount above the measured temperature of the second fluid stream. The controller is configured to determine the mode of operation to be "cooling plus heat recovery" when the cooling set point is lower than the measured temperature of the first fluid stream by a first temperature amount and the heating set point is greater than the measured temperature of the second fluid stream by a second temperature amount less than the first temperature amount. The controller is configured to determine the mode of operation to be "heating only" when the cooling set point is greater than or equal to the measured temperature of the first fluid stream and the heating set point is greater than the measured temperature of the second fluid stream. The controller is configured to determine the mode of operation to be "defrost" when the measured ambient air temperature is below a threshold outdoor temperature. The controller is configured to determine the mode of operation to be "heating plus limited cooling" when the cooling set point is less than the measured temperature of the first fluid stream by a first temperature amount and the heating set point is greater than the measured temperature of the second fluid stream by a second amount greater than the first temperature amount.

DRAWINGS

DETAILED DESCRIPTION

The present disclosure is directed to heating, ventilating, air conditioning and refrigeration (HVAC&R) systems that are configured to operate in multiple operating modes to meet desired heating and cooling demands. More specifically, the present embodiments are directed to heat pumps that use a compressor system, a condenser, an evaporator, and an outdoor coil to address the heating, cooling, heat recovery, defrost, and other demands associated with the heat pump. The heat pump may be operable in a "cooling only" mode, a "100% heat recovery" mode, a "cooling plus heat recovery" mode, a "heating only" mode, a "defrost" mode, and a "heating plus limited cooling" mode, depending on the demand for heating and cooling, ambient air temperature, and other factors. To facilitate these different operating modes, present embodiments of the heat pump may include several controllable features, such as valves, expansion devices, a coil fan, condenser pump, and evaporator pump. The heat pump may include a controller configured to determine the mode of operation of the heat pump and to control the valves, expansion devices, pumps, and fan to operate the heat pump in the desired mode. In some embodiments, the heat pump may be designed to facilitate a flow of refrigerant through the outdoor coil in different directions for different operating modes. In other embodiments, the flow of refrigerant through the coil may be in the same direction during all modes of operation. Some embodiments of the heat pump may include a subcooler that provides additional auxiliary heating of a fluid pumped through the subcooler. These heat pump arrangements may enable a single HVAC&R unit to support a range of simultaneous heating and cooling loads across a range of ambient temperatures, using relatively simple and consolidated controls.

Figure 1:
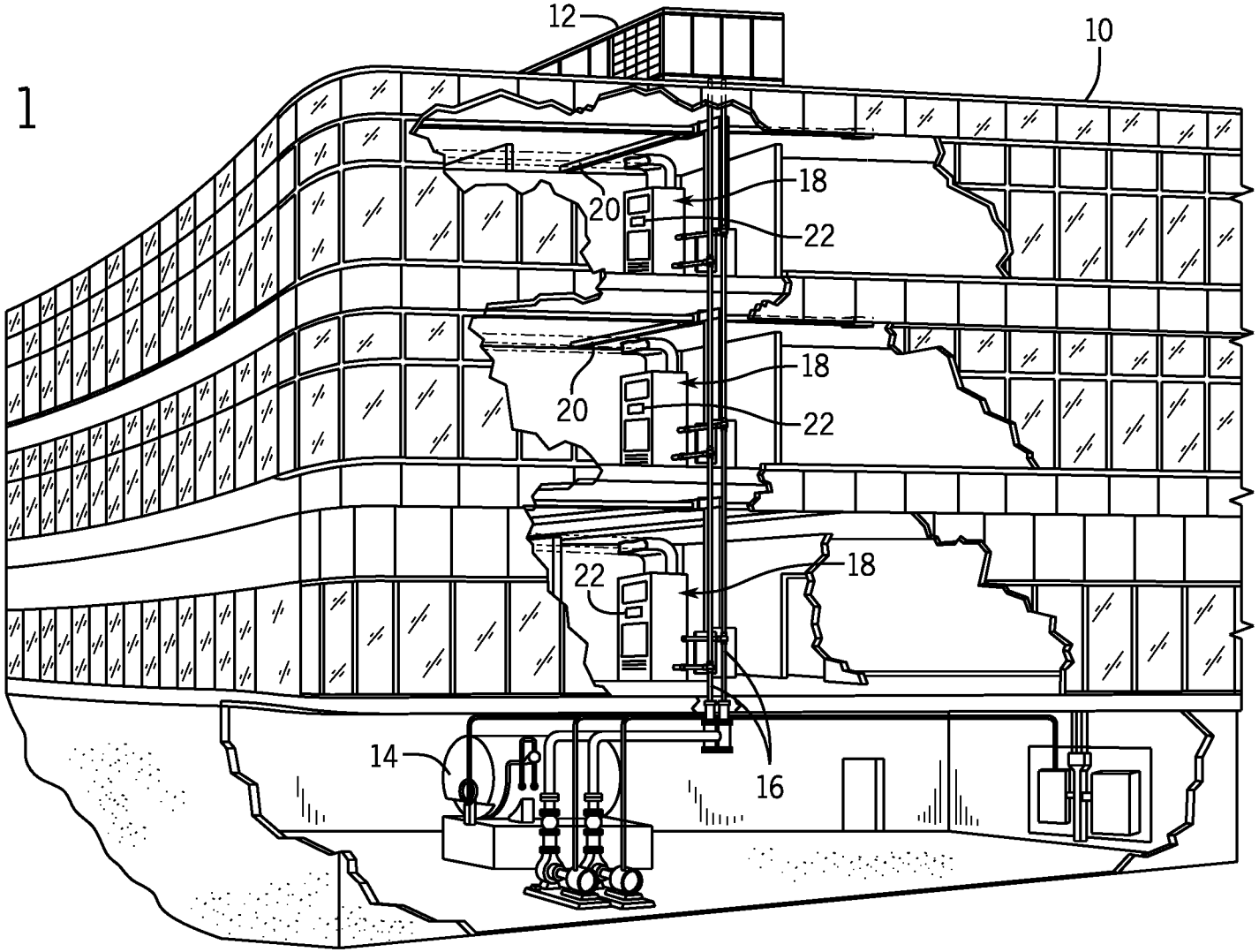
FIG. 1 is perspective cutaway view of a commercial heating ventilating, air conditioning and refrigeration (HVAC&R) system that includes a heat pump that operates in multiple modes, in accordance with an embodiment of the present techniques.

FIG. 1 depicts an exemplary application for a refrigeration system. Such systems, in general, may be applied in a range of settings, both within the HVAC&R field and outside of that field. The refrigeration systems may provide cooling to data centers, electrical devices, freezers, coolers, or other environments through vapor-compression refrigeration, absorption refrigeration, or thermoelectric cooling. In presently contemplated applications, however, refrigeration systems may be used in residential, commercial, light industrial, industrial, and in any other application for heating or cooling a volume or enclosure, such as a residence, building, structure, and so forth. Moreover, the refrigeration systems may be used in industrial applications, where appropriate, for basic refrigeration and heating of various fluids.

FIG. 1 illustrates an exemplary application, in this case an HVAC&R system for building environmental management that may employ heat exchangers. A building 10 is cooled by a system that includes a chiller 12 and a boiler 14. As shown, the chiller 12 is disposed on the roof of the building 10 and the boiler 14 is located in the basement; however, the chiller 12 and boiler 14 may be located in other equipment rooms or areas next to the building. The chiller 12 is an air cooled or water cooled device that implements a refrigeration cycle to cool water (or some other heat transfer fluid). The chiller 12 is housed within a single structure that includes a refrigeration circuit and associated equipment such as pumps, valves, and piping. For example, the chiller 12 may be a single package rooftop unit. The boiler 14 is a closed vessel in which water (or some other heat transfer fluid) is heated. The water from the chiller 12 and the boiler 14 is circulated through the building 10 by conduits 16. The conduits 16 are routed to air handlers 18, located on individual floors and within sections of the building 10.

The air handlers 18 are coupled to ductwork 20 that is adapted to distribute air between the air handlers 18 and may receive air from an outside intake (not shown). The air handlers 18 include heat exchangers that circulate cold water from the chiller 12 and hot water from the boiler 14 to provide heated or cooled air. Fans, within the air handlers 18, draw air through the heat exchangers and direct the conditioned air to environments within the building 10, such as rooms, apartments, or offices, to maintain the environments at a designated temperature. A control device 22, shown here as including a thermostat, may be used to designate the temperature of the conditioned air. The control device 22 also may be used to control the flow of air through and from the air handlers 18. Other devices may, of course, be included in the system, such as control valves that regulate the flow of water and pressure and/or temperature transducers or switches that sense the temperatures and pressures of the water, the air, and so forth. Moreover, control devices may include computer systems that are integrated with or separate from other building control or monitoring systems, and even systems that are remote from the building.

Heat Pump System Configured to Operate in Multiple Operating Modes

Figure 2:
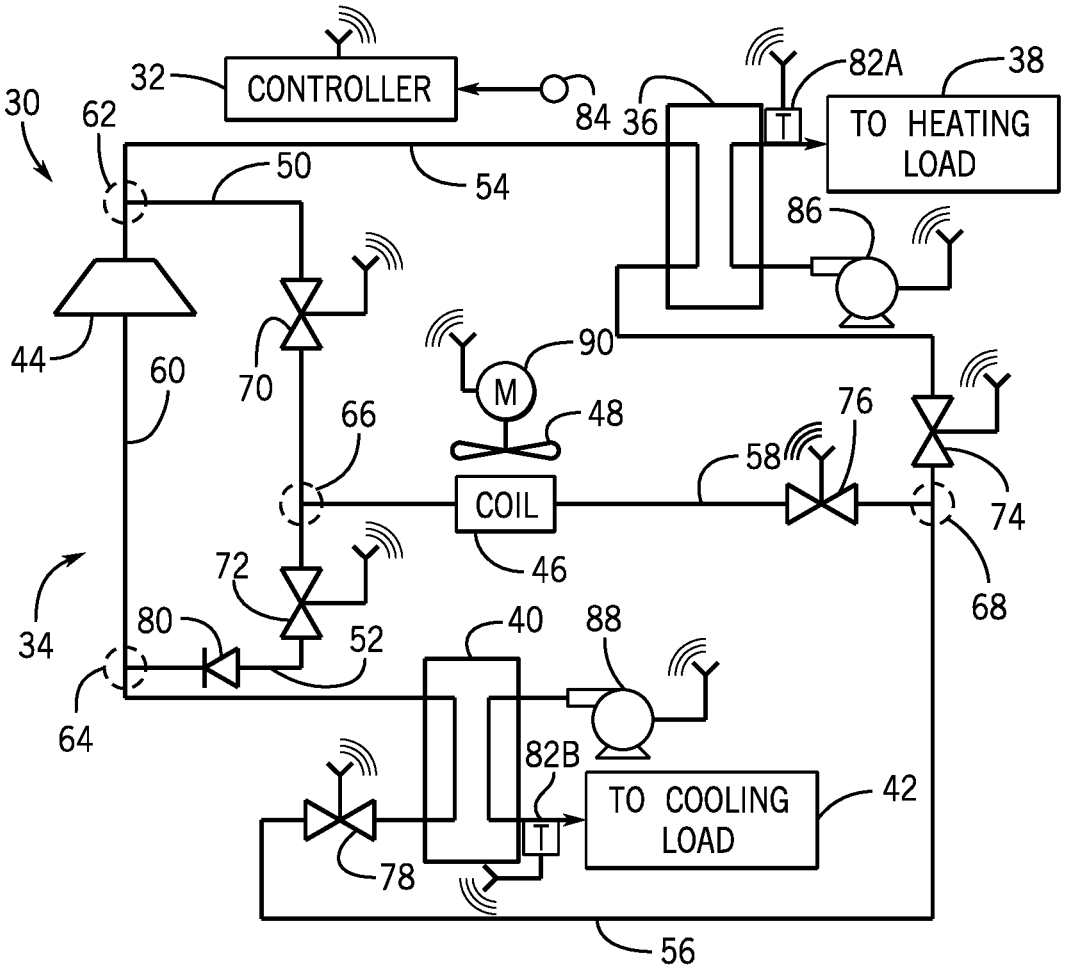
FIG. 2 is a diagrammatical representation of a heat pump system configured to operate in multiple modes, in accordance with an embodiment of the present techniques.

FIG. 2 is a diagrammatical representation of a heat pump 30 with multiple operating modes. The heat pump 30 may be a single unit that provides cooled and/or heated water to the building 10 via conduits 16, similar to the system of FIG. 1. As discussed further below, the heat pump 30 may be configured to operate in several different modes to provide the desired cooling, heating, and other applications. For example, the heat pump 30 may provide one or more of cooling, heating, heat recovery, and defrost via the same heat pump arrangement. A controller 32 may be configured to control components of the heat pump 30 to switch the heat pump 30 between different operating modes.

The heat pump 30 includes a closed loop 34 that circulates a heat transfer fluid (e.g., refrigerant) to heat exchangers. The refrigerant may be any fluid that absorbs and extracts heat. For example, the refrigerant may be a hydrofluorocarbon (HFC) based R-410A, R-407C, or R-134a, or it may be carbon dioxide (R-744) or ammonia (R-717) or hydrofluoroolefin (HFO) based. The heat exchangers include a condenser 36 configured to condenser refrigerant and an evaporator 40 configured to vaporize refrigerant. According to certain embodiments, the condenser 36 may be a shell and tube heat exchanger having one or more tubes, and the evaporator 40 may be a shell and tube evaporator, falling film evaporator, flooded evaporator, or a hybrid of a falling film and flooded evaporator. The heat exchangers facilitate heat transfer between the refrigerant and a cooling fluid (or heating fluid), such as chilled water, an ethylene glycol-water solution, brine, or the like. Heating and cooling loops powered via pumps may circulate the heating fluid and/or cooling fluid to the conduits 16 shown in FIG. 1. In certain embodiments, the heating fluid and the cooling fluid may circulate to a heating load 38 and a cooling load 42, respectively. These heating and cooling loads 38 and 42 may include a research laboratory, computer room, office building, hospital, molding and extrusion plant, food processing plant, industrial facility, machine or any other environments or devices in need of heating/cooling.

In addition to these heat exchangers, the heat pump 30 includes a compressor system 44 and a coil 46. The compressor system 44 may be representative of one or more compressors configured to compress vaporized refrigerant. In the illustrated embodiment, the coil 46 is an outdoor coil that transfers heat between the refrigerant and the outdoor ambient air, which is facilitated by a fan 48. The fan 48 may be operable at different speeds (e.g., via a variable speed motor or through fan staging). When the heat pump 30 is operated in different modes, the refrigerant may be conveyed through the coil 46 in different directions. For example, the refrigerant may flow from the compressor system 44 to the coil 46 via a discharge line 50 of the closed loop 34. At other times, the refrigerant may flow from the coil 46 to the compressor system 44 via a suction line 52 (e.g., a conduit between the coil 46 and a suction of the compressor system 44) of the closed loop 34. The coil 46 is configured to receive the refrigerant from the condenser 36 or from the discharge line 50 (e.g., a conduit between a discharge of the compressor system 44 and the coil 46), to selectively transfer heat to or from the refrigerant flowing therethrough, and to transfer the refrigerant to the evaporator 40 or to the suction line 52.

As illustrated, the closed loop 34 includes multiple closed loops through which the refrigerant may be directed via a series of controllable valves. Each of the closed loops may correspond to one or more operating modes of the heat pump 30. The loops may include different fluid flow lines that convey the refrigerant through different components, and these flow lines are connected at certain junctions. More specifically, the condenser may be located along a condenser line 54 (e.g., a conduit between a discharge of the compressor system 44 and a discharge of the condenser 36), the evaporator 40 may be located along an evaporator line 56 (e.g., a conduit between a discharge of the condenser 36 and a discharge of the evaporator 40), the coil 46 may be located along a coil line 58 (e.g., a conduit between one end of the coil 46 and the other end of the coil 46), and the compressor system 44 may be located along a compressor line 60 (e.g., a conduit between a discharge of the evaporator 40 and a discharge of the compressor system 44).

The compressor line 60 is coupled to the condenser line 54 and the discharge line 50 at a junction 62 at a discharge end of the compressor line 60. The compressor line 60 is also coupled to both the evaporator line 56 and the suction line 52 at a junction 64 at a suction end of the compressor line 60. Refrigerant is directed into the compressor line 60 at the suction end and out of the compressor line 60 at the discharge end. The coil line 58 is coupled to the discharge line 50 and the suction line 52 at a junction 66 at one end of the coil line 58. The coil line is also coupled to both the condenser line 54 and the evaporator line 56 at a junction 68 at an opposite end of the coil line 58. It should be noted that in some embodiments, other arrangements of the relative positioning of the lines that form the closed loop 34 may be used.

As noted above, the flow of refrigerant through the closed loop 34 may be directed through the actuation of valves disposed at specific positions along the closed loop 34. For example, in the illustrated embodiment, the heat pump 30 includes a first valve 70 disposed along the discharge line 50 and a second valve disposed along the suction line 72. The first valve 70 is configured to enable or prevent a flow of the compressed refrigerant from the compressor system 44 to the coil 46, depending on its open/closed position. Similarly, the second valve 72 is configured to enable or prevent a flow of the refrigerant from the coil 46 to the compressor system 44. In addition, the heat pump 30 may include expansion valves 74, 76, and 78. According to certain embodiments, the expansion valves 74, 76, and 78 may be thermal expansion valves or electronic expansion valves that are operated by controller 32 to vary refrigerant flow in response to suction superheat, evaporator liquid level, or other parameters. More specifically, the expansion valves 74, 76, and 78 are configured to enable or prevent a flow of refrigerant through the condenser 36, the coil 46, and the evaporator 40, respectively.

In the illustrated embodiment, the first expansion valve 74 is disposed along an outlet side of the condenser line 54 between the condenser 36 and the junction 68. The second expansion 76 valve is disposed along the coil line 58 between the coil 46 and the junction 68. The third expansion valve 78 is disposed along an inlet side of the evaporator line 56 between the junction 68 and the evaporator 40. In the illustrated embodiment, the heat pump 30 also includes a check valve 80 disposed along the suction line 52 to maintain a desired direction of flow of the refrigerant through the suction line 52. The check valve 80 may be a ball check valve, diaphragm check valve, swing check valve, or some other type of check valve suitable for providing unidirectional flow. It should be noted that other valves, including expansion valves and check valves, may be positioned along different lines of the heat pump 30 than those illustrated in this embodiment.

To control the desired operational mode of the heat pump 30, as well as the desired temperature gradients across the condenser 36 and the evaporator 40, the heat pump 30 may include sensors 82 configured to measure one or more operating parameters (e.g., temperature, pressure, etc.) of the refrigerant and/or the heating and cooling loads 38 and 42. For example, the heat pump 30 may include a heating temperature sensor 82A configured to measure a temperature of the fluid stream heated by the condenser 36, and a cooling temperature sensor 82B configured to measure a temperature of the fluid stream cooled by the evaporator 40. Other sensors 84 may be configured to measure temperature and/or pressure conditions of the ambient air. For example, the sensor 84 may include an ambient air temperature sensor configured to measure the temperature of ambient air outside the coil 46. The sensors 82 and 84 may provide measured feedback to the controller 32 (e.g., an automation controller, programmable logic controller, distributed control system, etc.) by a wireless or hard wired connection. The controller 32 may be configured to determine a mode of operation of the heat pump 30 based at least in part on a heating set point (e.g., desired temperature of the heated fluid exiting the evaporator 40) for the heated fluid stream, a cooling set point (e.g., desired temperature of the cooled fluid exiting the condenser 36) for the cooled fluid stream, the measured temperature of the heated fluid stream (e.g., measured by sensor 82A), the measured temperature of the cooled fluid stream (e.g., measured by sensor 82B), and the measured ambient air temperature (e.g., measured by sensor 84).

In the illustrated embodiment, the controller 32 is further configured to regulate (e.g., automatically) operation of one or more of the valves 70 and 72 and expansion devices 74, 76, and 78 in response to feedback measured by the sensors or received as user inputs to the controller 32. In other embodiments, the valves 70 and 72 and/or the expansion devices 74, 76, and 78 may be operated manually. Additionally, the controller 32 may control other processes of the heat pump 30, such as operation of pumps 86 and 88 that pump heating and cooling fluid through the condenser 36 and the evaporator 40, respectively, as well as operation and speed of a motor 90 that turns the fan 48. The controller 32 may control these features (e.g., 70, 72, 74, 76, 78, 86, 88, and 90) based on the determined mode of operation of the heat pump 30.

The controller 32 may execute hardware or software control algorithms to regulate operation of the heat pump 30. According to exemplary embodiments, the controller 32 may include an analog to digital (A/D) converter, one or more microprocessors, circuitry, or general or special purpose computers, a non-volatile memory, memory circuits, and an interface board. For example, the controller 32 may include memory circuitry for storing programs and control routines and algorithms implemented for control of the various system components, such the valves 70, 72, 74, 76, 78, the fan motor 90, and the pumps 86 and 88. The controller 32 also includes, or is associated with, input/output circuitry for receiving sensed signals from input sensors (e.g., 82A, 82B, 84) and interface circuitry for outputting control signals for the valves 70, 72, 74, 76, 78, the fan motor 90, and the pumps 86 and 88. For example, the controller 32 will also typically control, for example, valving for an economizer line, speed and loading of the compressor system 44, and so forth, and the memory circuitry may store set points, actual values, historic values and so forth for any or all such parameters. Other devices may, of course, be included in the system, such as additional pressure and/or temperature transducers or switches that sense temperatures and pressures of the refrigerant, the coil, the evaporator, the condenser, the compressor, the inlet and outlet air, and so forth. Further, other values and/or set points based on a variety of factors, such as system capacity, cooling load, heating load, and the like may be used to determine when to operate the heat pump 30 in certain modes. The controller 32 also may include components for operator interaction with the system, such as display panels and/or input/output devices for checking operating parameters, inputting set points and desired operating parameters, checking error logs and historical operations, and so forth.

Control and Operating Modes of the Heat Pump System

Having described in detail the general layout of the heat pump 30, a discussion of the multiple heating, cooling, and other modes of operation of the heat pump 30 will be provided. Specifically, the illustrated embodiment of the heat pump 30 may be operated in a "cooling only" mode, a "100% heat recovery" mode, a "cooling plus heat recovery" mode, a "heating only" mode, a "defrost" mode, and a "heating plus limited cooling" mode. The valve positions, fan speed, and pump controls for each of these operating modes are summarized in table 1 below:

TABLE 1

Heat pump modes of operation and corresponding control schemes

| Mode | First Valve 70 | Second Valve 72 | First Expansion Valve 74 | Second Expansion Valve 76 | Third Expansion Valve 78 | Fan 48 | Cond. Pump 86 | Evap. Pump 88 |
|---|---|---|---|---|---|---|---|---|
| Cooling only | Open | Closed | Bleed | Open | Modulate | On | Off | On |
| 100% heat recovery | Closed | Closed | Open | Closed | Modulate | Off | On | On |
| Cooling plus heat recovery | Open | Closed | Modulate | Modulate | Modulate | Modulate | On | On |
| Heating only | Closed | Open | Open | Modulate | Closed | On | On | Off |
| Defrost | Open | Closed | Closed | Open | Modulate | Off | Off | On |
| Heating plus limited cooling | Closed | Open | Open | Modulate | Modulate | Modulate | On | On |

"Cooling only" mode refers to a mode of operation where the heat pump 30 uses its heat transfer capabilities solely for providing cooling fluid to the cooling load 42. The heat pump 30 may be operated in the cooling mode, for example, during hot summer days when cooled fluid is used for air conditioning and there is no demand for heating. The controller 32 may be configured to determine the mode of operation of the heat pump 30 to be "cooling only" when the cooling set point is lower than the measured temperature of the fluid stream exiting the condenser 36 and the heating set point is lower than or equal to the measured temperature of the fluid stream exiting the evaporator 40.

In the cooling mode, refrigerant is compressed in the compressor system 44 and exits through the discharge line 50. The compressed refrigerant then flows through the first valve 70, which is opened during the "cooling only" mode. Since the second valve 72 is closed, the compressed refrigerant travels into the coil line 58 via the junction 66 and flows through the coil 46 where the refrigerant is cooled and condensed to a liquid. The condensed refrigerant exits the coil 46 and flows through the open second expansion valve 76, the junction 68, and the line 56 with the third expansion valve 78. Liquid refrigerant flashes after the third expansion valve 78 to produce a two-phase flow of refrigerant, and the third expansion valve 78 is modulated to supply the two-phase refrigerant to the evaporator 40. As the evaporator pump 88 pumps fluid through the evaporator 40, heat transfers from the fluid to the expanded refrigerant. This cools the fluid, which is provided to the cooling load 42. The evaporator 40 boils the liquid refrigerant, and the vaporized refrigerant flows back to the compressor system 44 via the compressor line 60. As noted in Table 1, the first expansion valve 74 may be cracked in the cooling mode, allowing a small flow of refrigerant to bleed through the condenser line 54. This may prevent accumulation of excess refrigerant liquid or oil in the condenser 36. In the cooling mode, the condenser pump 86 is off, since there is no demand for heating.

The "100% heat recovery" mode refers to a mode of operation where the heat pump 30 provides auxiliary heating to the heating load 38 using approximately all of the heat normally rejected to the environment via the coil 46, while still cooling fluid via the evaporator 40. The heat pump 30 may be operated in the 100% heat recovery mode, for example, when a certain amount of both cooling and heating are desired. The controller 32 may be configured to determine the mode of operation of the heat pump 30 to be "100% heat recovery" when the cooling set point is approximately a threshold temperature amount below the measured temperature of the fluid exiting the condenser 36 and the heating set point is approximately the same threshold temperature amount above the measured temperature of the fluid exiting the evaporator 40.

In the "100% heat recovery" mode, the first and second valves 70 and 72 and the second expansion valve 76 are closed to keep refrigerant from flowing through the coil 46. In some embodiments, the second expansion valve 76 may be open in this mode of operation. The full discharge flow of compressed refrigerant from the compressor system 44 may flow through the condenser 36. As the condenser pump 86 pushes fluid through the condenser 36, the fluid absorbs heat from the refrigerant flowing through the condenser 36 to produce a heated fluid that is directed to the heating load 38. From the condenser 36, the refrigerant then travels through the first expansion valve 74, which is open in this mode. Since the second expansion valve 76 is closed, the expanded refrigerant flows from the condenser line 54 through the junction 68 and into the evaporator line 56. From here the refrigerant flows through the third expansion valve 78, which flashes the refrigerant into two phases and modulates the flow of the two-phase refrigerant flows into the evaporator 40, as discussed above with respect to the cooling mode. The evaporator 40 boils the liquid refrigerant, and vaporized refrigerant exits the evaporator 40 and flows back to the compressor system 44 via the compressor line 60.

Slight variations to the "100% heat recovery" mode controls listed above may be applied in certain contexts. For example, in embodiments where some amount of leakage occurs through the closed first valve 70 or second expansion valve 76 surrounding the coil 46, it may be desirable to periodically open the first valve 70 or the second valve 72 while modulating the second expansion valve 76. This may flush liquid refrigerant and oil out of the outdoor coil 46. In this mode, there is minimal heat transfer occurring through the coil 46 because the fan 48 is off.

The "cooling plus heat recovery" mode refers to a mode of operation where the heat pump 30 provides cooling via the evaporator by expelling heat to both the atmosphere via the air-cooled coil and to the auxiliary heating load 38. The operating mode may be used when a certain amount of heating and cooling are desired simultaneously, such that the demand for heating is less than 100% of the heat recoverable from the compressed refrigerant. The controller 32 may be configured to determine the mode of operation to be "cooling plus heat recovery" when the cooling set point is greater than or equal to the measured temperature of the fluid exiting the evaporator 40 by a first temperature amount and the heating set point is greater than the measured temperature of the fluid stream exiting the condenser 36 by a second temperature amount less than the first temperature amount.

In the "cooling plus heat recovery" mode, the first valve 70 is open and the second valve 72 is closed. The compressed refrigerant flows through the junction 62 into both the condenser line 54 and the discharge line 50. The condenser 36 condenses the compressed refrigerant that enters the condenser line 36, rejecting heat to the heating fluid being pumped through the condenser 36 and toward the heating load 38. The coil 46 cools and condenses the compressed refrigerant that enters the coil line 58, rejecting heat to the atmosphere. The first and second expansion valves 74 and 76 provide the condensed refrigerant from the coil 46 and the condenser 36 into the evaporator line 56 via the junction 68. The expansion valves 74 and 76 are modulated to prevent an excessive accumulation of refrigerant in the condenser 36. From here the refrigerant flows through the third expansion valve 78, which flashes the refrigerant into two phases and modulates the flow of the two-phase refrigerant into the evaporator 40. The evaporator 40 boils the liquid refrigerant, and vaporized refrigerant exits the evaporator 40 and flows back to the compressor system 44 via the compressor line 60. In this mode, the fan 48 of the coil 46 is on and, in some embodiments, the fan speed may be adjusted (e.g., via the controller 32) to maintain a desired condensing temperature necessary to meet the heat recovery demand of the heating load 38.

The "heating only" mode refers to a mode of operation where the heat pump 30 uses its heat transfer capabilities solely for providing heated fluid to the heating load 38. The heat pump 30 may be operated in the "heating only" mode, for example, during cold nights in order to provide heating to a building. The controller 32 may be configured to determine the mode of operation to be "heating only" when the cooling set point is greater than or equal to the measured temperature of the fluid stream exiting the evaporator 40 and the heating set point is greater than the measured temperature of the fluid stream exiting the condenser 36.

In the "heating only" mode, the first valve 70 is closed and the second valve 72 is opened. The compressed refrigerant flows from the compressor system 44 to the condenser 36 and not to the coil 46. As the condenser pump 86 pushes fluid through the condenser 36, the fluid absorbs heat from the refrigerant flowing through the condenser 36 to produce a heated fluid that is directed to the heating load 38. From the condenser 36, the refrigerant then travels through the first expansion valve 74, which is open in the heating mode. The third expansion valve 78 is closed in this mode to prevent the condensed refrigerant from flowing into the evaporator 40. As a result, the condensed refrigerant flows into the coil line 58 via the junction 68 and through the second expansion valve 76. The second expansion valve 76 may be modulated to supply the refrigerant to the coil 46. The coil 46 acts as an evaporator to transfer heat from the air to the refrigerant, thereby heating the refrigerant for use in the condenser 36. The fan 48 operates generally at full capacity in this operating mode to move air across the coil 46. The refrigerant may return to the compressor system 44 via the second valve 72 and the compressor line 60.

The "defrost" mode is a mode of operation where the heat pump 30 is used to provide heat to the outdoor coil 46 in order to defrost the coil 46. The heat pump 30 may be operated in the defrost mode, for example, when the ambient outdoor temperature is so low that the outdoor coil 46 may freeze. The controller 32 may be configured to determine the mode of operation to be "defrost" when the measured ambient air temperature is below a threshold outdoor temperature at which the coil 46 might freeze.

In the "defrost" mode, the first valve 70 is open and the second valve 72 is closed. In addition, the fan 48 is off to prevent unnecessary loss of heat through the coil 46. Compressed refrigerant flows from the compressor system 44 to the coil 46 and not to the condenser 36 (or very little to the condenser 36), since the first expansion valve 74 is closed. The compressed refrigerant flows through the coil 46, where it is condensed. The condensed refrigerant exits the coil 46 and flows through the open second expansion valve 76, the junction 68, and the evaporator line 56 with the third expansion valve 78. In the defrost mode, the third expansion valve 78 is modulated to supply the liquid refrigerant to the evaporator 40. Relatively hot water is pumped via the pump 88 into the evaporator 40 in order to boil the liquid refrigerant flowing through the evaporator 40. The vaporized refrigerant flows back to the compressor system 44 via the compressor line 60.

The "heating plus limited cooling" mode refers to an operating mode where the heat pump 30 provides heating to the heating load 38 via the condenser 36 and some cooling to the cooling load 42 via the evaporator 40. The heat pump 30 may be operated in the "heating plus limited cooling" mode, for example, at relatively low ambient temperatures when both heating and cooling demands are present. The controller 32 may be configured to determine the mode of operation to be "heating plus limited cooling" when the cooling set point is less than the measured temperature of the fluid stream exiting the evaporator 40 by a first temperature amount and the heating set point is greater than the measured temperature of the fluid stream exiting the condenser 36 by a second temperature amount greater than the first temperature amount.

In the "heating plus limited cooling" mode, the first valve 70 is closed and the second valve 72 is open. The compressed refrigerant flows from the compressor system 44 to the condenser 36 and not to the coil 46. As the condenser pump 86 pushes fluid through the condenser 36, the fluid absorbs heat from the refrigerant flowing through the condenser 36 to produce a heated fluid that is directed to the heating load 38. From the condenser 36, the refrigerant then travels through the first expansion valve 74, which is open in this mode. The third expansion valve 78 is modulated in this mode to allow the condensed refrigerant to flow into the evaporator 40 periodically. The second expansion valve 76 may be modulated to supply the refrigerant to the coil 46 periodically. As a result, part of the condensed refrigerant flows into the coil line 58 via the junction 68 and through the second expansion valve 76, and another part flows into the evaporator line 56 via the junction 68 and through the third expansion valve 78. The coil 46 acts as an evaporator to transfer heat from the air to the refrigerant, thereby heating the refrigerant for use in the condenser 36. Similarly, the evaporator 40 facilitates heat transfer from the cooling fluid to the refrigerant.

By modulating the second expansion valve 76, the third expansion valve 78, and the fan 48, it may be possible to limit the temperature of the cooled water leaving the evaporator 40 so that the water does not freeze on its way to the cooling load 42. That is, the fan 48 may be operated at different speeds, and the expansion valves 76 and 78 may be opened to varying degrees so that the refrigerant entering the evaporator 40 is relatively higher in temperature than it would be otherwise.

Figure 13:
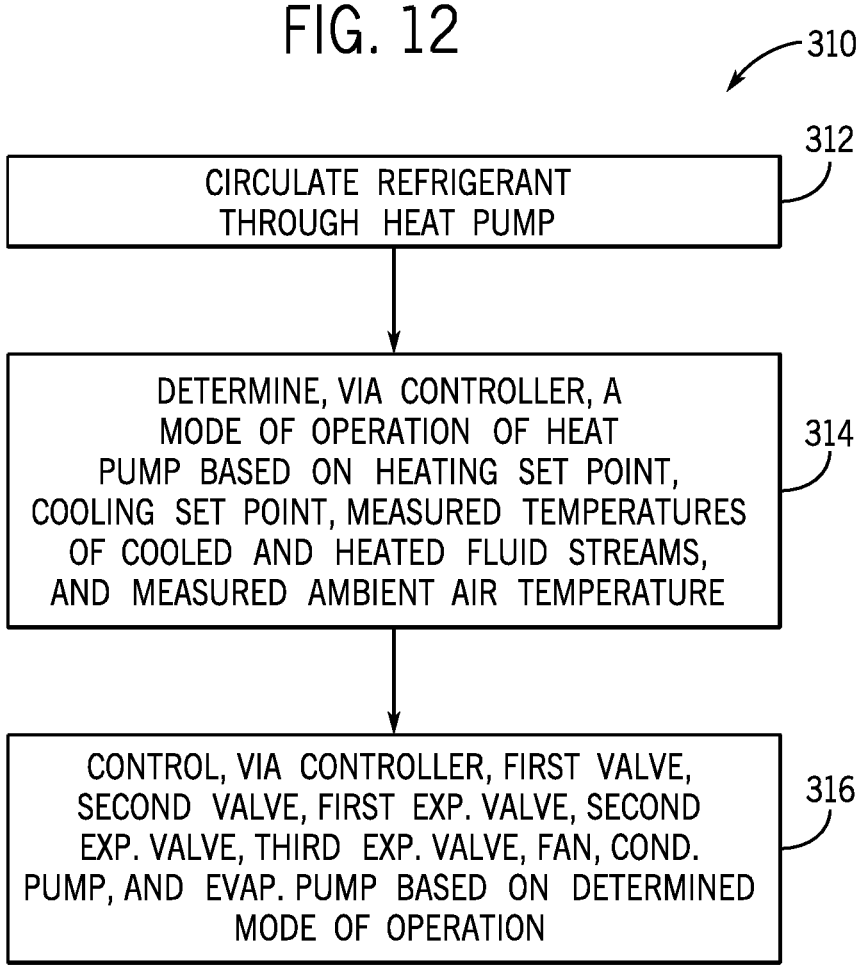
FIG. 13 is a process flow diagram illustrating a method of operating a heat pump, in accordance with an embodiment of the present techniques.

FIG. 13 is a process flow diagram illustrating a method 310 of operating the heat pump 30, including providing the desired control of the heat pump 30 based on measured parameters. More specifically, the method 310 includes circulating (block 312) the refrigerant through the heat pump 30, as discussed in detail above. The method 310 also includes determining (block 314), via the controller 32, a mode of operation of the heat pump 30 based on a heating set point, a cooling set point, measured temperatures of the cooled and heated fluid streams (e.g., measured by sensors 82B and 82A, respectively), and the measured ambient air temperature (e.g., measured by sensor 84). The heating and cooling set points may be obtained directly from or calculated based on inputs from an operator setting a thermostat, or some other control device. In addition, the method 310 includes controlling (block 316), via the controller 32, the first valve 70, the second valve 72, the first expansion valve 74, the second expansion valve 76, the third expansion valve 78, the fan 90, the condenser pump 86, and the evaporator pump 88 based on the determined mode of operation of the heat pump 30. This control is described in detail above.

Figure 14:
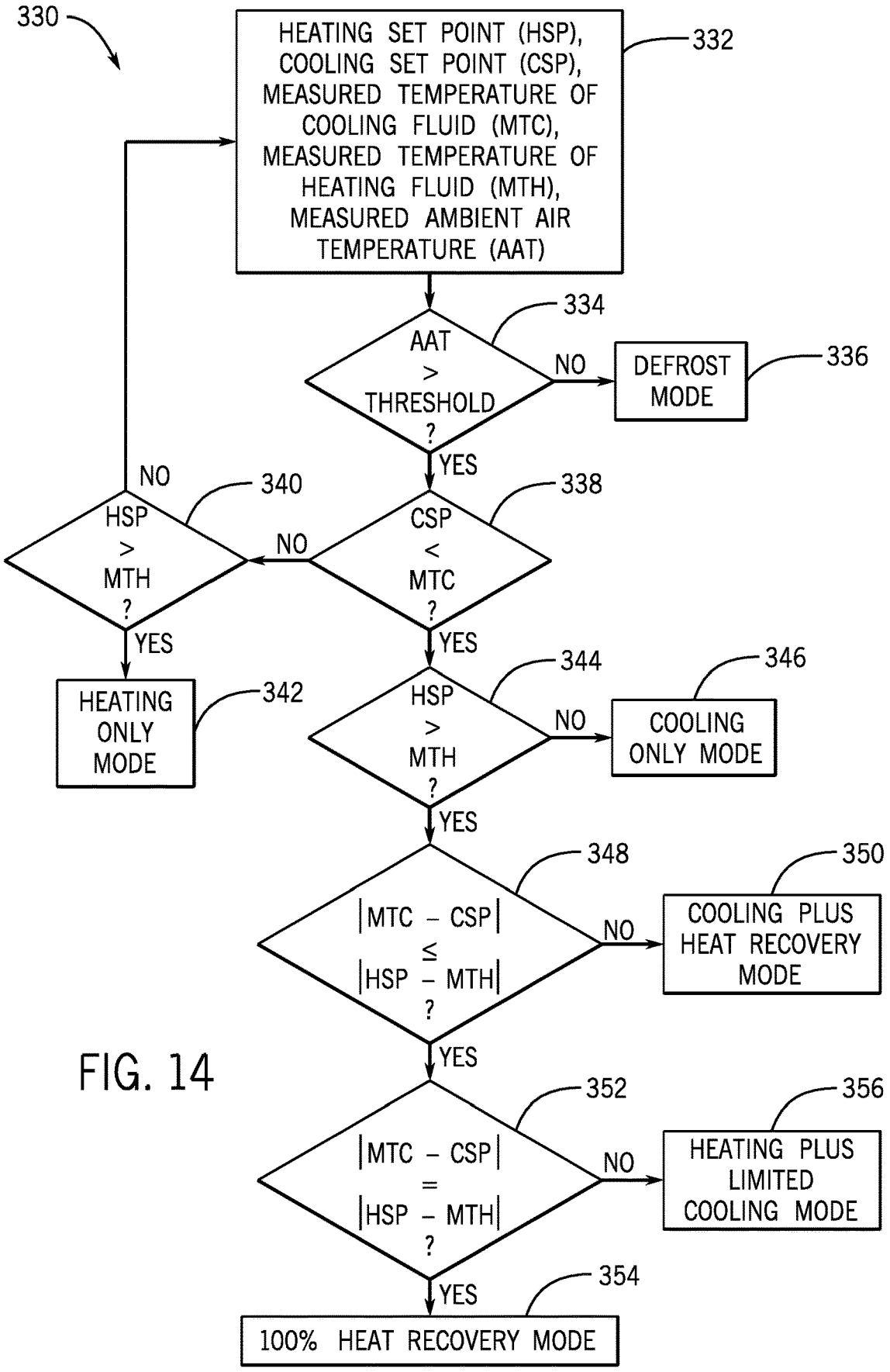
FIG. 14 illustrates a method for determining a mode of operation of a heat pump, in accordance with an embodiment of the present techniques.

FIG. 14 illustrates a method 330 for determining the mode of operation of the heat pump 30. The illustrated method 330 may be executed as an algorithm via a processing feature of the controller 32 to determine a current mode of operation for the heat pump 30 based on several factors (block 332), including the heating set point, the cooling set point, the measured temperature of the cooled fluid exiting the evaporator, the measured temperature of the heated fluid exiting the condenser, and the measured ambient air temperature. The steps of this algorithm may be stored in a memory feature of the controller 32. It should be noted that in some embodiments steps of the method 330 may be performed in different orders than those shown, or omitted altogether. In addition, some of the blocks illustrated may be performed in combination with each other.

The method 330 includes determining (block 334) whether the measured ambient air temperature is greater than a threshold temperature. If the ambient air temperature is less than the threshold temperature, the controller 32 may determine (block 336) the operating mode of the heat pump 30 to be the "defrost" mode, as described above. If the measured ambient air temperature is greater than the threshold temperature, the method 330 may include determining (block 338) whether the cooling set point is less than the measured temperature of the cooled fluid stream. If the cooling set point is greater than or equal to the measured temperature of the cooled fluid stream, the controller 32 may determine (block 340) whether the heating set point is greater than the measured temperature of the heated fluid stream. If the heating set point is greater than the measured temperature of the heated fluid stream, the controller 32 may determine (block 342) the operating mode of the heat pump 30 to be the "heating only" mode. If the cooling set point is less than the measured temperature of the cooled fluid stream, the method 330 includes determining (block 344) whether the heating set point is greater than the measured temperature of the heated fluid stream and, if it is not, then determining (block 346) the mode of operation to be the "cooling only mode". The method 330 includes, if the heating set point is determined (block 344) to be greater than the measured temperature of the heated fluid stream, determining (block 348) whether the difference between measured cooled fluid temperature and the cooling set point is less than or equal to the difference between the measured heated fluid temperature and the heating set point. If the cooling temperature difference is greater than the heating temperature difference, the method 330 includes determining (block 350) the mode of operation to be the "cooling plus heat recovery mode". If the cooling temperature difference is determined (block 352) to be equal to the heating temperature difference, the controller 32 may determine (block 354) the mode of operation to be the "100% heat recovery" mode. If the cooling temperature difference is less than the heating temperature difference, the controller 32 may determine (block 356) the mode of operation to be the "heating plus limited cooling" mode. As discussed above, based on the determined mode of operation, the controller 32 may control the heat pump 30 to operate in the desired mode to provide the desired amount of heating, cooling, defrost, heat recovery, or combination thereof, to a building.

Heat Pump Configuration with Subcooler

Figure 3:
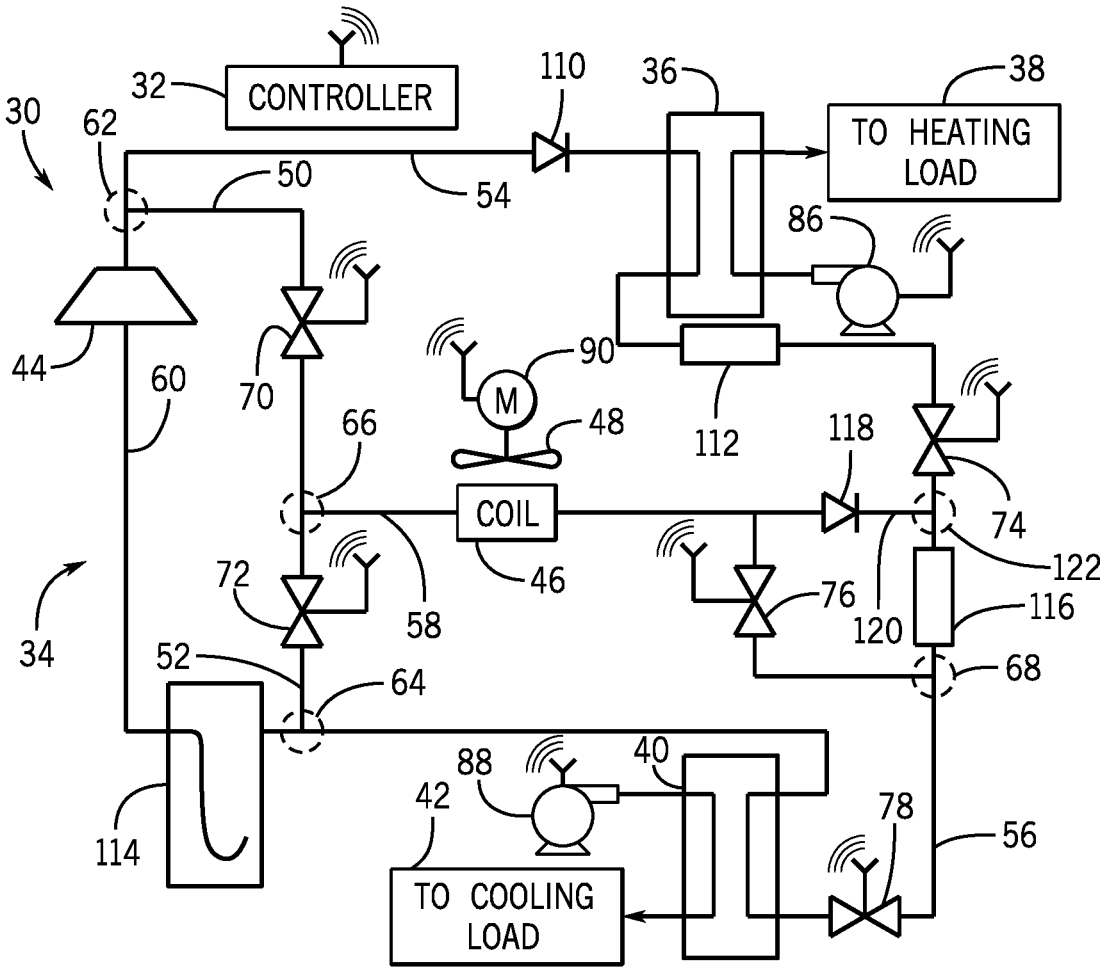
FIG. 3 is a diagrammatical representation of a heat pump system configured to operate in multiple modes, in accordance with an embodiment of the present techniques.

Having discussed a basic configuration and operation of the heat pump 30 configured to operate in multiple modes, a description of another embodiment of the heat pump 30 is now provided. FIG. 3 is a diagrammatical representation of an embodiment of the heat pump 30 similar to the embodiment illustrated in FIG. 2, but having additional components. More specifically, the illustrated embodiment includes a discharge check valve 110, a receiver 112, an accumulator 114, an economizer or subcooler 116, and another check valve 118.

The operation of the heat pump 30 illustrated in FIG. 3 is similar to the operations described above in relation to FIG. 2. In the illustrated embodiment, the check valve 110 is disposed in the condenser line 54 between the junction 62 and the condenser 36. This check valve 110 may prevent excess liquid refrigerant from leaving the receiver 112 during the defrost mode.

In the illustrated embodiment, the receiver 112 is disposed in the condenser line 54 between the condenser 36 and the first expansion valve 74. The receiver 112 may temporarily store liquid refrigerant that exits the condenser 36 when the load on the downstream evaporator 40 (or coil 46) is relatively low. That is, when the expansion valves 74, 76, and/or 78 are modulated to allow a portion of the liquid refrigerant to flow toward downstream components (e.g., coil 46, evaporator 40, etc.), the remaining liquid refrigerant is stored in the receiver 112 and does not back up in the condenser 36. In some embodiments, the receiver 112 may be sized so that it is full of liquid refrigerant during the "heating only" mode and relatively empty of refrigerant in the "cooling only" mode.

In the illustrated embodiment, the accumulator 114 is disposed along the suction side of the compressor line 60. That is, the accumulator 114 may be positioned along the compressor line 60 between the junction 64 and the compressor system 44. The accumulator 114 functions as a holding tank for any small amount of liquid refrigerant that passes through the evaporator 40 or the coil 46 without being vaporized. Thus, the accumulator 114 may ensure that non-compressible liquid refrigerant does not enter and damage the compressor system 44. This may be particularly useful for removing excess liquid refrigerant when the heat pump 30 is operating in the "defrost" mode. The accumulator 114 may facilitate a pressure drop through the compressor line 60 during all modes of operation. In other embodiments, the accumulator 114 may be disposed along the suction line 52, so that the pressure drop occurs only during modes of operation where the second valve 72 is open (e.g., "heating only" and "heating plus limited cooling" modes). Other positions within the heat pump 30 may be appropriate for the accumulator 114 as well.

The subcooler 116 may be another heat exchanger that functions to further cool refrigerant to a temperature below a saturation temperature of the refrigerant, so that the refrigerant flows therefrom in liquid form. Thus, the subcooler 116 is able to transition the refrigerant into a relatively stable state to flow through the rest of the heating and/or cooling cycle. The subcooler 116 may be liquid cooled, meaning that it may be configured to transfer heat from the refrigerant flowing therethrough to an additional fluid stream. In this way, the water flowing through the subcooler 116 may be heated by the refrigerant, and the heated water may function as a heat source for any desired application in the HVAC&R system. For example, the heated water flowing from the subcooler 116 may be used as a heat source for the evaporator 40 (or some other piece of equipment) during defrost mode, as discussed below. In other embodiments, the heated water may be used to provide heating to the building when it is cold outside.

In some embodiments, the subcooler 116 may be positioned along the condenser line 54 between the first expansion valve 74 and the junction 68. In order to take advantage of the subcooler 116 when the refrigerant is directed through the coil 46 in either direction, an additional line 120 may be disposed between the coil line 58 and the condenser line 54. As illustrated, the line 120 may intersect the condenser line 54 at a junction 122, and the subcooler 116 may be positioned between the junctions 122 and 68. The optional check valve 118 may be located along this additional line 120. In the illustrated embodiment, the check valve 118 directs warm liquid refrigerant exiting the coil 46 to the subcooler 116 during cooling modes (e.g., "cooling only", "cooling plus heat recovery") where the refrigerant flows through the coil 46 in a first direction. In heating modes (e.g., "heating only", "heating plus limited cooling") where the refrigerant flows through the coil 46 in an opposite direction, liquid refrigerant flows from the condenser 36 through the subcooler 116 to the second expansion valve 76 before entering the coil 46.

Control and Operating Modes of the Heat Pump System with Subcooler

In the "cooling only" mode, refrigerant is compressed in the compressor system 44 and exits through the discharge line 50. The compressed refrigerant then flows through the first valve 70. Since the second valve 72 is closed, the compressed refrigerant travels into the coil line 58 via the junction 66 and flows through the coil 46 where the refrigerant is cooled and condensed to a liquid. The condensed refrigerant exits the coil 46 through the line 120 and flows into the subcooler 116, which ensures that the flow is in a subcooled liquid state. The liquid refrigerant then flows through the third expansion valve 78. Liquid refrigerant flashes after the third expansion valve 78 to produce a two-phase flow of refrigerant, and the third expansion valve 78 is modulated to supply the two-phase refrigerant to the evaporator 40. As the evaporator pump 88 pumps fluid through the evaporator 40, heat transfers from the fluid to the expanded refrigerant. This cools the fluid, which is provided to the cooling load 42. The evaporator 40 boils the liquid refrigerant, and the vaporized refrigerant flows back to the compressor system 44 via the accumulator 114 and the compressor line 60. In this embodiment, the receiver 112 may store any excess refrigerant liquid or oil in the condenser line 54. In addition, the first expansion valve 74 may be cracked to allow a small flow of refrigerant to bleed through the condenser line 54.

In the "100% heat recovery" mode, the first and second valves 70 and 72 and the second expansion valve 74 are closed to keep refrigerant from flowing through the coil 46. The full discharge flow of compressed refrigerant from the compressor system 44 may flow through the condenser 36. As the condenser pump 86 pushes fluid through the condenser 36, the fluid absorbs heat from the refrigerant flowing through the condenser 36 to produce a heated fluid that is directed to the heating load 38. From the condenser 36, the refrigerant then travels through the receiver 112 and to the first expansion valve 74. Since the second expansion valve 76 is closed, the expanded refrigerant flows from the condenser line 54 through the subcooler 116, the junction 68, and into the evaporator line 56. From here the refrigerant flows through the third expansion valve 78, which flashes the refrigerant into two phases and modulates the flow of the two-phase refrigerant flows into the evaporator 40. The evaporator 40 boils the liquid refrigerant, and vaporized refrigerant exits the evaporator 40 and flows back to the compressor system 44 via the accumulator 114 and the compressor line 60.

In the "cooling plus heat recovery" mode, the first valve 70 is open and the second valve 72 is closed. The compressed refrigerant flows through the junction 62 into both the condenser line 54 and the discharge line 50. The condenser 36 condenses the compressed refrigerant that enters the condenser line 36, rejecting heat to the heating fluid being pumped through the condenser 36 and toward the heating load 38. The coil 46 cools and condenses the compressed refrigerant that enters the coil line 58, rejecting heat to the atmosphere. The first expansion valve 74 and the check valve 118 provide the condensed refrigerant from the coil 46 and the condenser 36 into the evaporator line 56 via the subcooler 116 and the following junction 68. As discussed above, the receiver 112 may prevent an excessive accumulation of refrigerant in the condenser 36. The refrigerant flows through the third expansion valve 78, which flashes the refrigerant into two phases and modulates the flow of the two-phase refrigerant into the evaporator 40. The evaporator 40 boils the liquid refrigerant, and vaporized refrigerant exits the evaporator 40 and flows back to the compressor system 44 via the accumulator 114 and the compressor line 60. As discussed in detail above, the fan 48 of the coil 46 is on and, in some embodiments, the fan speed may be adjusted (e.g., via the controller 32) to maintain a desired condensing temperature necessary to meet a heat recovery demand of the heating load 38.

In the "heating only" mode, the first valve 70 is closed and the second valve 72 is opened. The compressed refrigerant flows from the compressor system 44 to the condenser 36 and not to the coil 46. As the condenser pump 86 pushes fluid through the condenser 36, the fluid absorbs heat from the refrigerant flowing through the condenser 36 to produce a heated fluid that is directed to the heating load 38. From the condenser 36, the refrigerant then travels through the open first expansion valve 74 and the receiver 112. The third expansion valve 78 is closed in this mode to prevent the condensed refrigerant from flowing into the evaporator 40. As a result, the condensed refrigerant flows through the subcooler 116 and into the coil line 58 via the junction 68. In the coil line 58, the liquid refrigerant flows through the second expansion valve 76, which may be modulated to supply the refrigerant to the coil 46. The coil 46 acts as an evaporator to transfer heat from the air to the refrigerant, thereby heating the refrigerant for use in the condenser 36. The fan 48 operates generally at full capacity in this operating mode to move air across the coil 46. The refrigerant may return to the compressor system 44 via the second valve 72, the accumulator 114, and the compressor line 60.

In the "defrost" mode, the first valve 70 is open and the second valve 72 is closed. In addition, the fan 48 is off to prevent unnecessary loss of heat through the coil 46. Compressed refrigerant flows from the compressor system 44 to the coil 46 and not to the condenser 36 (or very little to the condenser 36), since the first expansion valve 74 is closed. The compressed refrigerant flows through the coil 46, where it is condensed. The condensed refrigerant exits the coil 46 and flows through the subcooler 116, the evaporator line 56, and the third expansion valve 78. In the defrost mode, the third expansion valve 78 is modulated to supply the liquid refrigerant to the evaporator 40. Relatively hot water is pumped via the pump 88 into the evaporator 40 in order to boil the liquid refrigerant flowing through the evaporator 40. The vaporized refrigerant flows back to the compressor system 44 via the accumulator 114 and the compressor line 60.

In the "heating plus limited cooling" mode, the first valve 70 is closed and the second valve 72 is open. The compressed refrigerant flows from the compressor system 44 to the condenser 36 and not to the coil 46. As the condenser pump 86 pushes fluid through the condenser 36, the fluid absorbs heat from the refrigerant flowing through the condenser 36 to produce a heated fluid that is directed to the heating load 38. From the condenser 36, the refrigerant then travels through the receiver 112 and the open first expansion valve 74. The condensed refrigerant flows through the subcooler 116 to ensure that the refrigerant is in liquid form. Part of the liquid refrigerant flows into the coil line 58 via the junction 68 and the second expansion valve 76, and another part flows into the evaporator line 56 via the junction 68 and the third expansion valve 78. The second expansion valve 76 may be modulated to supply the refrigerant to the coil 46 periodically, and the third expansion valve 78 is modulated in this mode to allow the condensed refrigerant to flow into the evaporator 40 periodically. The coil 46 acts as an evaporator to transfer heat from the air to the refrigerant, thereby heating the refrigerant for use in the condenser 36. Similarly, the evaporator 40 facilitates heat transfer from the cooling fluid to the refrigerant. The refrigerant then returns to the compressor system 44 via the accumulator 114 and the compressor line 60.

Heat Pump System with Flash Tank Economizer

Figure 4:
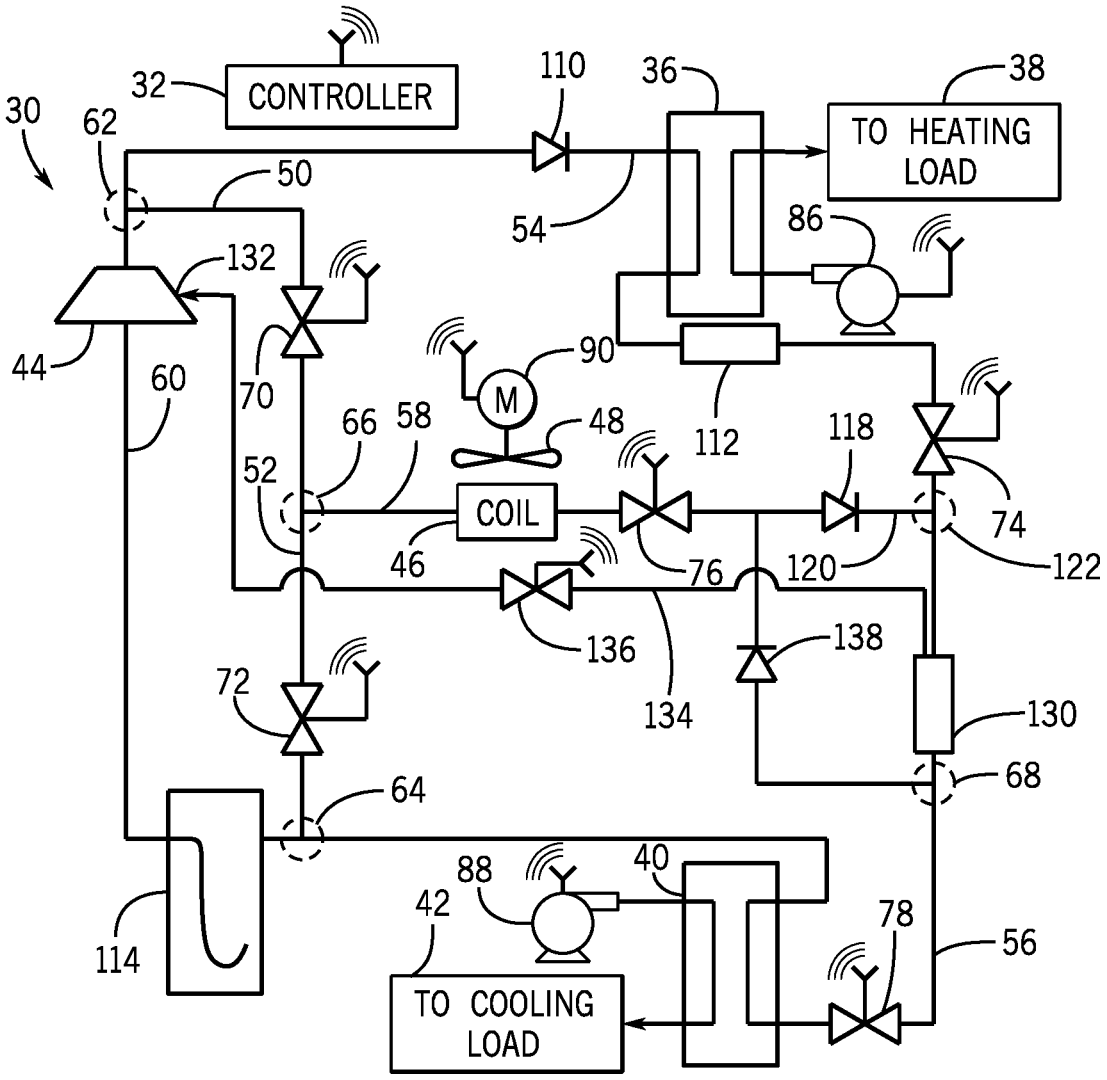
FIG. 4 is a diagrammatical representation of a heat pump system configured to operate in multiple modes, in accordance with an embodiment of the present techniques.

It should be noted that the subcooler 116, in other embodiments, may be replaced by any type of economizer designed to output cooled refrigerant. For example, FIG. 4 illustrates an embodiment of the heat pump 30 that is similar to the embodiment illustrated in FIG. 3, except that the heat pump 30 includes a flash tank economizer 130 instead of a subcooler. The flash tank 130 may be disposed in the same relative position along the condenser line 54 between the first expansion valve 74 and the junction 68.

The flash tank 130 is configured to receive refrigerant flowing down between the junction 122 and the junction 68. The flash tank 130 is configured to separate incoming refrigerant into liquid and vapor phases. The flash tank 130 is configured to provide a flow of liquid phase refrigerant toward the junction 68, where it is routed to the coil 46 and/or to the evaporator 40 depending on the mode of operation of the heat pump 30. The vapor phase refrigerant exits the flash tank 130 through an upper portion of the flash tank 130, where the flash tank 130 discharges the flow of vapor refrigerant to an economizer port 132 of the compressor system 44 through an economizer line 134. An optional economizer valve 136 may control the flow of refrigerant through the flash tank 130. The economizer valve 136 may be a solenoid valve, ball valve, gate valve, rotor valve, continuously variable valve, or the like, controlled by electromechanical actuators, pneumatic actuators, hydraulic actuators, or other suitable controls. From the economizer valve 136, the vapor phase refrigerant is directed to the compressor system 44 through the economizer port 132.

In the "heating only" mode, liquid refrigerant exits the condenser 36, flows through the receiver 112, and flashes through the first expansion valve 74, and the resulting two-phase refrigerant flow enters the flash tank 130. Liquid refrigerant exits the bottom of the flash tank 130 and flows through a check valve 138 into the coil line 58. In this mode, the third expansion valve 78 is closed such that substantially all the liquid refrigerant is routed to the coil 46, which functions as an evaporator. The vaporized refrigerant may flow to the compressor system 44 via the second valve 72 and the accumulator 114. In the "100% heat recovery" mode, the second expansion valve 76 is closed and the third expansion valve 78 is modulated. Thus, the liquid refrigerant exiting the flash tank 130 is routed to the evaporator 40 instead of the coil 46. In both the "heating only" mode and the "100% heat recovery" mode, the refrigerant vapor flows from the top of the flash tank 130 to the economizer port 132 of the compressor system 44.

As discussed above, the flow of refrigerant through the heat pump 30 may be controlled through the actuation of the different valves (e.g., 70, 72, 74, 76, 78, and 136) of the heat pump 30. For example, the expansion valves 74, 76, and 78 may be operated, manually or by the controller 32, to vary refrigerant flow in response to suction superheat, evaporator liquid level, or other parameters. In the illustrated embodiment, the expansion valve 74, 76, and 78 may be modulated based on flash tank level and compressor suction superheat. More specifically, the expansion valves 74, 76, and 78 may deliver the refrigerant through the heat pump 30 at a pressure that enables the refrigerant to fully vaporize before reaching the compressor system 44, and without completely evacuating the flash tank 130 of liquid refrigerant. It should be noted that other parameters, including receiver liquid level, compressor discharge superheat, and/or accumulator liquid level, may be monitored and used as feedback for controlling the expansion valve 74, 76, and 78 of the heat pump 30.

Heat Pump System with Non-Reversing Flow Through the Coil

Figure 5:
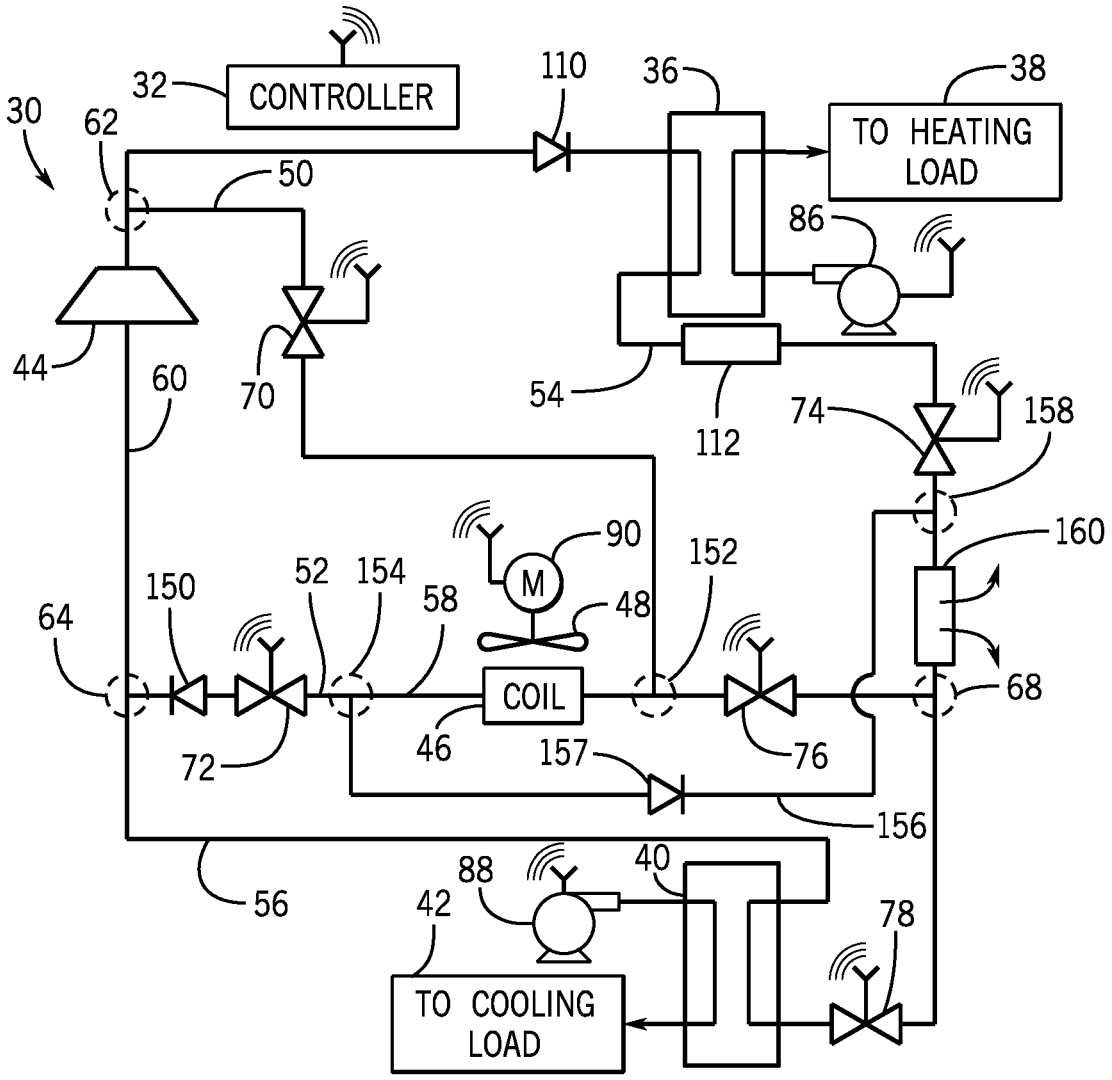
FIG. 5 is a diagrammatical representation of a heat pump system configured to operate in multiple modes, in accordance with an embodiment of the present techniques.

The embodiments illustrated and described above all facilitate reversible flow of refrigerant through the coil 46. That is, in certain modes (e.g., "heating only", "heating plus limited cooling"), the refrigerant flows through the coil 46 in an opposite direction than it does other modes (e.g., "cooling only", "cooling plus heat recovery", "defrost"). In other embodiments, the heat pump 30 may be configured to allow for non-reversing flow of refrigerant through the coil 46. FIG. 5 illustrates one such embodiment of the heat pump 30. By enabling non-reversing flow through the coil 46, the illustrated embodiment may be designed with approximately a counterflow heat exchanger arrangement that allows air to be blown over multiple rows of coil tubes in a direction approximately opposite the flow of refrigerant through the tubes, during all modes of operation. This may enable more efficient operation of the coil 46 and the heat pump 30 than would be available in a reversing flow arrangement.

In the illustrated embodiment, the heat pump 30 includes the first and second valves 70 and 72. In the non-reversing flow embodiment, the valves 70 and 72 may be pilot operated solenoid valves. The second valve 72 is disposed in series with a first check valve 150, and this check valve 150 prevents backflow of refrigerant or oil from the evaporator line 56 to the coil line 58 when the pressure through the coil 46 is less than the pressure through the evaporator 40.

Unlike previously discussed embodiments, the illustrated discharge line 50 and suction line 52 do not meet with the coil line 58 at the same junction. The discharge line 50 having the first valve 70 is coupled to the coil line 58 at a junction 152 on one side of the coil 46, and the suction line 52 having the second valve 72 is coupled to the coil line 58 at a junction 154 on an opposite end of the coil 46. In the illustrated embodiment, the junction 152 is between the coil 46 and the second expansion valve 76, and the junction 154 is at an end of the coil line 58 opposite the junction 68.

A flow line 156 with a check valve 157 extends between the coil line 58 and the condenser line 54. More specifically, the flow line 156 may be coupled to the coil line 58 at the junction 154 at the end of the coil line 58 and coupled to the condenser line 54 at a junction 158. In the illustrated embodiment, the heat pump 30 includes an economizer/subcooler 160, which may be the subcooler 116 of FIG. 3 or the flash tank 130 of FIG. 4, among others. The junction 158 is disposed upstream of an entry point to the economizer/subcooler 160, while the junction 68 between the coil line 58 and the evaporator line 56 is disposed downstream of the economizer/subcooler 160 to receive the subcooled liquid refrigerant. In embodiments where the economizer/subcooler 160 is not present, the flow line 156 may be coupled to the condenser line 54 and the evaporator line 56 at the junction 68.

In the illustrated embodiment, the controller 32 is further configured to regulate (e.g., automatically) operation of one or more of the valves 70 and 72 and expansion devices 74, 76, and 78 in response to feedback measured by the sensors or received as user inputs to the controller 32. In other embodiments, the valves 70 and 72 and/or the expansion devices 74, 76, and 78 may be operated manually. Additionally, the controller 32 may control other processes of the heat pump 30, such as operation of pumps 86 and 88 that pump heating or cooling fluid through the condenser 36 and the evaporator 40, respectively, operation and speed of a motor 90 that turns the fan 48, and so forth.

Control and Operating Modes of the Heat Pump System with Non-Reversing Flow Through the Coil Having described in detail the general layout of the heat pump 30 with non-reversing flow through the coil 46, a discussion of the multiple heating, cooling, and other modes of operation of the heat pump 30 will be provided. Specifically, and as discussed above, the illustrated embodiment of the heat pump 30 may be operated in a "cooling only" mode, a "100% heat recovery" mode, a "cooling plus heat recovery" mode, a "heating only" mode, a "defrost" mode, and a "heating plus limited cooling" mode. The valve positions, fan speed, and pump controls for each of these operating modes are summarized in table 2 below:

TABLE 2

Heat pump modes of operation for non-reversing flow through coil

| Mode | First Valve 70 | Second Valve 72 | First Expansion Valve 74 | Second Expansion Valve 76 | Third Expansion Valve 78 | Fan 48 | Cond. Pump 86 | Evap. Pump 88 |
|---|---|---|---|---|---|---|---|---|
| Cooling only | Open | Closed | Bleed | Closed | Modulate | On | Off | On |
| 100% heat recovery | Closed | Closed | Open | Closed | Modulate | Off | On | On |
| Cooling plus heat recovery | Open | Closed | Modulate | Modulate | Modulate | Modulate | On | On |
| Heating only | Closed | Open | Open | Modulate | Closed | On | On | Off |
| Defrost | Open | Closed | Closed | Closed | Modulate | Off | Off | On |
| Heating plus limited cooling | Closed | Open | Open | Modulate | Modulate | Modulate | On | On |

The controls described in Table 2 differ from those in Table 1 in that the second expansion valve 76 is closed during the "cooling only" mode and during the "defrost" mode. In each of these six modes, refrigerant is directed through the coil 46 in the same direction, whether the coil 46 is acting as a condenser or an evaporator.

In the "cooling only" mode, refrigerant is compressed in the compressor system 44 and exits through the discharge line 50. The compressed refrigerant then flows through the first valve 70. Since the second valve 72 is closed, the compressed refrigerant travels into the coil line 58 via the junction 152. With the second expansion valve 76 closed, the refrigerant flows through the coil 46 where it is cooled and condensed to a liquid. That is, in the "cooling only" mode, the coil 46 acts as a condenser. The condensed refrigerant exits the coil 46 through the line 156 and flows into the economizer/subcooler 160. The liquid refrigerant exiting the economizer/subcooler 160 then flows through the third expansion valve 78. Liquid refrigerant flashes after the third expansion valve 78 to produce a two-phase flow of refrigerant, and the third expansion valve 78 is modulated to supply the two-phase refrigerant to the evaporator 40. As the evaporator pump 88 pumps fluid through the evaporator 40, heat transfers from the fluid to the expanded refrigerant. This cools the fluid, which is provided to the cooling load 42. The evaporator 40 boils the liquid refrigerant, and vaporized refrigerant flows back to the compressor system 44. As discussed above, the receiver 112 may store any excess refrigerant liquid or oil in the condenser line 54. In addition, the first expansion valve 74 may be cracked to allow a small flow of refrigerant to bleed through the condenser line 54.

In the "100% heat recovery" mode, the first and second valves 70 and 72 and the second expansion valve 74 are closed to keep refrigerant from flowing through the coil 46. The full discharge flow of compressed refrigerant from the compressor system 44 may flow through the condenser 36. As the condenser pump 86 pushes fluid through the condenser 36, the fluid absorbs heat from the refrigerant flowing through the condenser 36 to produce a heated fluid that is directed to the heating load 38. From the condenser 36, the refrigerant then travels through the receiver 112 and to the first expansion valve 74, which is open in this mode. Since the second expansion valve 76 is closed, the expanded refrigerant flows from the condenser line 54 through the economizer/subcooler 160 and into the evaporator line 56. From here the refrigerant flows through the third expansion valve 78, which flashes the refrigerant into two phases and modulates the flow of the two-phase refrigerant flows into the evaporator 40. The evaporator 40 boils the liquid refrigerant, and vaporized refrigerant exits the evaporator 40 and flows back to the compressor system 44.

In the "cooling plus heat recovery" mode, the first valve 70 is open and the second valve 72 is closed. The compressed refrigerant flows through the junction 62 into both the condenser line 54 and the discharge line 50. The condenser 36 condenses the compressed refrigerant that enters the condenser line 36, rejecting heat to the heating fluid being pumped through the condenser 36 and toward the heating load 38. The coil 46 cools and condenses the compressed refrigerant that enters the coil line 58, rejecting heat to the atmosphere. The first expansion valve 74 and the check valve 157 provide condensed refrigerant from condenser 36 and the coil 46 into the evaporator line 56 via the economizer/subcooler 160 and the following junction 68. From here the refrigerant flows through the third expansion valve 78, which flashes the refrigerant into two phases and modulates the flow of the two-phase refrigerant into the evaporator 40. The evaporator 40 boils the liquid refrigerant, and vaporized refrigerant exits the evaporator 40 and flows back to the compressor system 44.

In the "heating only" mode, the first valve 70 is closed and the second valve 72 is open. The compressed refrigerant flows from the compressor system 44 to the condenser 36 and not to the coil 46. As the condenser pump 86 pushes fluid through the condenser 36, the fluid absorbs heat from the refrigerant flowing through the condenser 36 to produce a heated fluid that is directed to the heating load 38. From the condenser 36, the refrigerant then travels through the receiver 112 and the open first expansion valve 74. The third expansion valve 78 is closed in this mode to prevent the condensed refrigerant from flowing into the evaporator 40. As a result, the condensed refrigerant flows through the economizer/subcooler 160 and into the coil line 58 via the junction 68. In the coil line 58, the liquid refrigerant flows through the second expansion valve 76, which may be modulated to supply the refrigerant to the coil 46. The coil 46 acts as an evaporator to transfer heat from the air to the refrigerant, thereby heating the refrigerant for use in the condenser 36. The refrigerant may return to the compressor system 44 via the second valve 72, the junction 64, and the compressor line 60.

In the "defrost" mode, the first valve 70 is open and the second valve 72 is closed. In addition, the fan 48 is off to prevent unnecessary loss of heat through the coil 46. Compressed refrigerant flows from the compressor system 44 to the coil 46 and not to the condenser 36 (or very little to the condenser 36), since the first expansion valve 74 is closed. The compressed refrigerant flows through the coil 46, where it is condensed. The condensed refrigerant exits the coil 46 and flows through the flow line 156, the economizer/subcooler 160, the evaporator line 56, and the third expansion valve 78. In the defrost mode, the third expansion valve 78 is modulated to supply the liquid refrigerant to the evaporator 40. Relatively hot water is pumped via the pump 88 into the evaporator 40 in order to boil the liquid refrigerant flowing through the evaporator 40, and the vaporized refrigerant flows back to the compressor system 44.

In the "heating plus limited cooling" mode, the first valve 70 is closed and the second valve 72 is open. The compressed refrigerant flows from the compressor system 44 to the condenser 36 and not to the coil 46. As the condenser pump 86 pushes fluid through the condenser 36, the fluid absorbs heat from the refrigerant flowing through the condenser 36 to produce a heated fluid that is directed to the heating load 38. From the condenser 36, the refrigerant then travels through the receiver 112 and the open first expansion valve 74. The condensed refrigerant flows through the economizer/subcooler 160 to ensure that the refrigerant is in liquid form. Part of the liquid refrigerant flows into the coil line 58 via the junction 68 and the second expansion valve 76, and another part flows into the evaporator line 56 via the junction 68 and the third expansion valve 78. The second expansion valve 76 may be modulated to supply the refrigerant to the coil 46 periodically. The third expansion valve 78 is modulated to allow the condensed refrigerant to flow into the evaporator 40 periodically. The coil 46 acts as an evaporator to transfer heat from the air to the refrigerant, thereby heating the refrigerant for use in the condenser 36. Similarly, the evaporator 40 facilitates heat transfer from the cooling fluid to the refrigerant. The refrigerant then returns to the compressor system 44 via the junction 64 and the compressor line 60.

Refrigerant Distributor for Non-Reversing Flow Through the Coil

Figure 6:
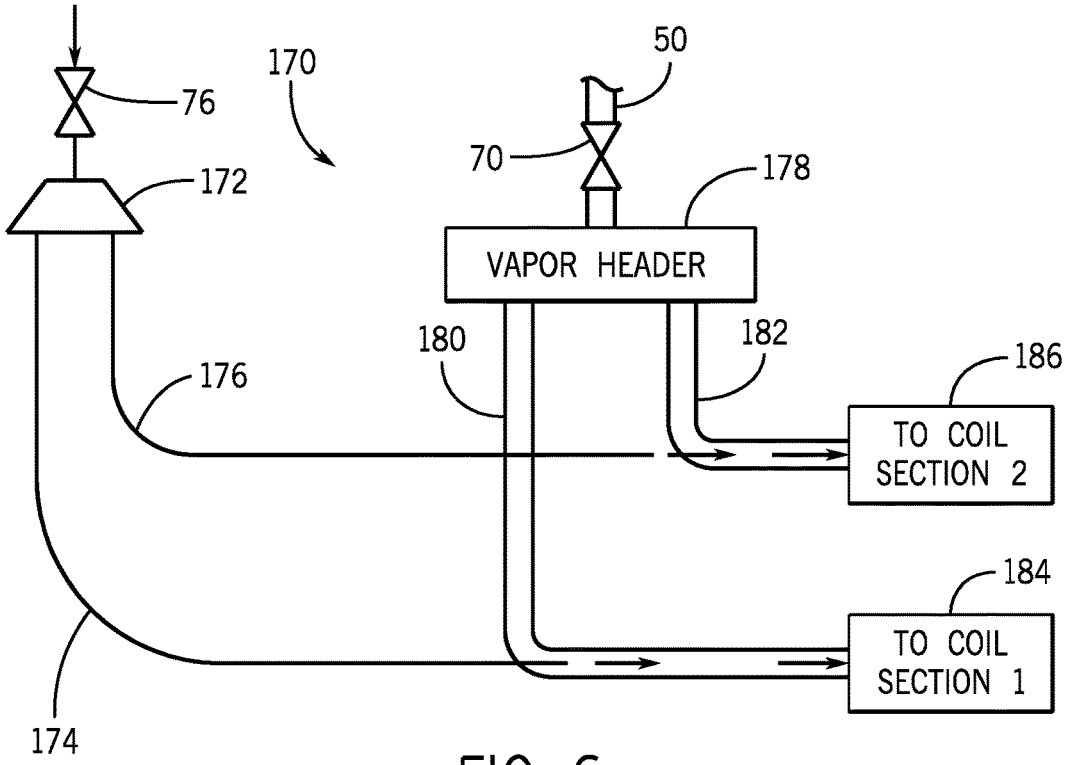
FIG. 6 is a diagrammatical representation of a liquid distribution system for a non-reversing coil, in accordance with an embodiment of the present techniques.

Having discussed the overall layout of the heat pump 30 that enables a non-reversing flow of refrigerant through the coil 46 regardless of whether the coil 46 is functioning as a condenser or an evaporator, a detailed description of a system for distributing the non-reversing flow of refrigerant to the coil 46 is provided. FIG. 6 illustrates an embodiment of a refrigerant distribution system 170 that may be used to route the liquid and/or vapor refrigerant into the coil 46. This type of distribution system 170 may be present at the junction 152 that distributes refrigerant from the second valve 76 and from the discharge line 50 into the coil 46.

In the illustrated embodiment, the distribution system 170 includes a liquid distributor 172 coupled between the second expansion valve 76 and two restriction tubes 174 and 176. The distribution system 170 may also include a vapor header 178 coupled between the first valve 70 and multiple vapor connections 180 and 182. In the illustrated embodiment, the vapor header 178 is positioned physically above the vapor connections 180 and 182. Liquid refrigerant flowing through the first restriction tube 174, vapor refrigerant flowing through the first vapor connection 180, or both are routed toward a first section 184 of the coil 46. Liquid refrigerant flowing through the second restriction tube 176, vapor refrigerant flowing through the second vapor connection 182, or both are routed toward a second section 186 of the coil 46. This type of distribution system 170 may be used to provide refrigerant to an embodiment of the coil 46 that includes multiple parallel refrigerant flow paths. Although the illustrated distribution system 170 provides refrigerant to just two flow paths (e.g., sections 184 and 186) of the coil 46, the same arrangement may be used to distribute refrigerant to any desired number of flow paths through the coil 46.

When the heat pump 30 operates in the "cooling only" mode or in the "defrost" mode, the first valve 70 is open and the second expansion valve 76 is closed. As a result, the compressed refrigerant vapor flows from the discharge line 50 and the first valve 70 into the vapor header 178 and down into the vapor connections 180 and 182 leading to the coil sections 184 and 186, respectively. When the heat pump 30 operates in the "heating only" mode or the "heating plus limited cooling" mode, the first valve 70 is closed and the second expansion valve 76 is modulated to provide a controlled flow of liquid refrigerant through the restrictor tubes 174 and 176. The restrictor tubes 174 and 176 may provide approximately equal flow of the liquid refrigerant to the coil connections 184 and 186, respectively. In the "cooling plus heat recovery" mode, the first valve 70 is open and the second expansion valve 76 modulates. This provides a balanced flow of the liquid refrigerant and of the discharged vapor refrigerant to the coil connections 184 and 186. In the "100% heat recovery" mode, both the first valve 70 and the second expansion valve 76 are closed, preventing the refrigerant from entering the coil sections 184 and 186.

It should be noted that the distribution system 170 may automatically compensate for any minor imbalance in heat transfer occurring within the coil 46. For example, if the first coil section 184 is experiencing better heat transfer than the second coil section 186, the pressure drop through the first coil section 184 would be higher than the pressure drop through the second coil section 186. Since the coil sections 184 and 186 share a common outlet pressure (e.g., into the coil line 58), the higher pressure drop through the first coil section 184 corresponds to a higher inlet pressure of the first vapor connection 180. If the vapor connections 180 and 182 are sufficiently large in diameter and the vertical velocity of the vapor flowing down the vapor connections 180 and 182 is sufficiently low, portions of the refrigerant vapor may be able to flow upward from the vapor connections 180 and 182. In response to a pressure differential between the coil connections 184 and 186, the refrigerant vapor may flow up the first vapor connection 180, through the vapor header 178, and down into the second vapor connection 182. As a result, the additional refrigerant vapor flowing into the second coil section 186 may displace a portion of liquid refrigerant that would otherwise have been routed to the second coil section 186. In this way, the disclosed distribution system 170 may automatically prevent overfeeding of liquid to a section of the coil 46 with poorer heat transfer than other sections.

Condenser Configurations for Use in Heat Pump

Figure 7:
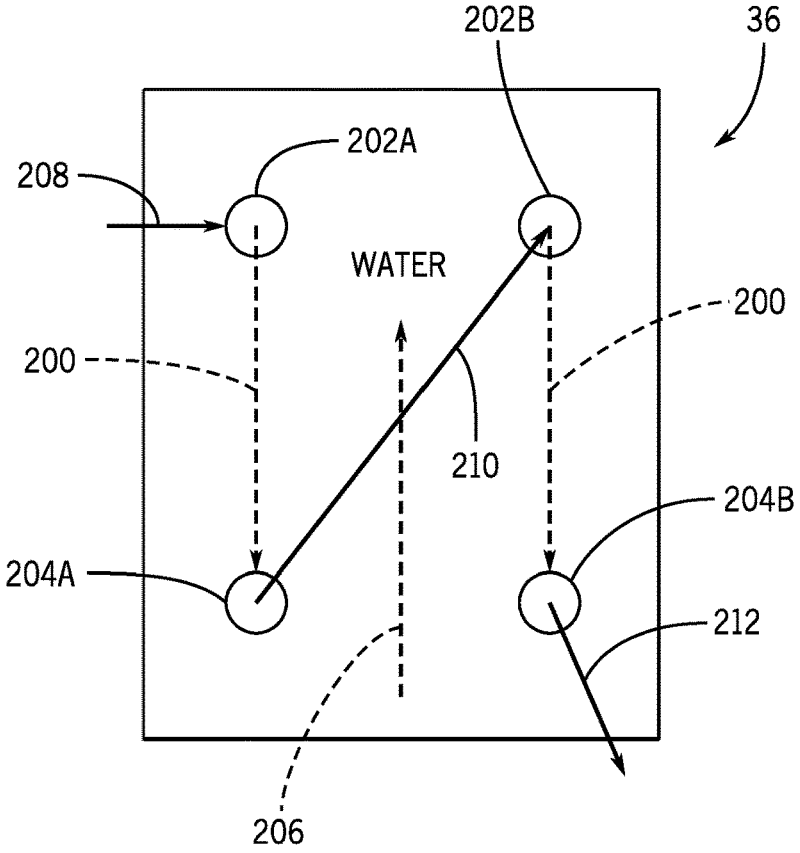
FIG. 7 is a diagrammatical representation of a single circuit condenser for use in the heat pump systems of FIG. 3-5, in accordance with an embodiment of the present techniques.
Figure 8:
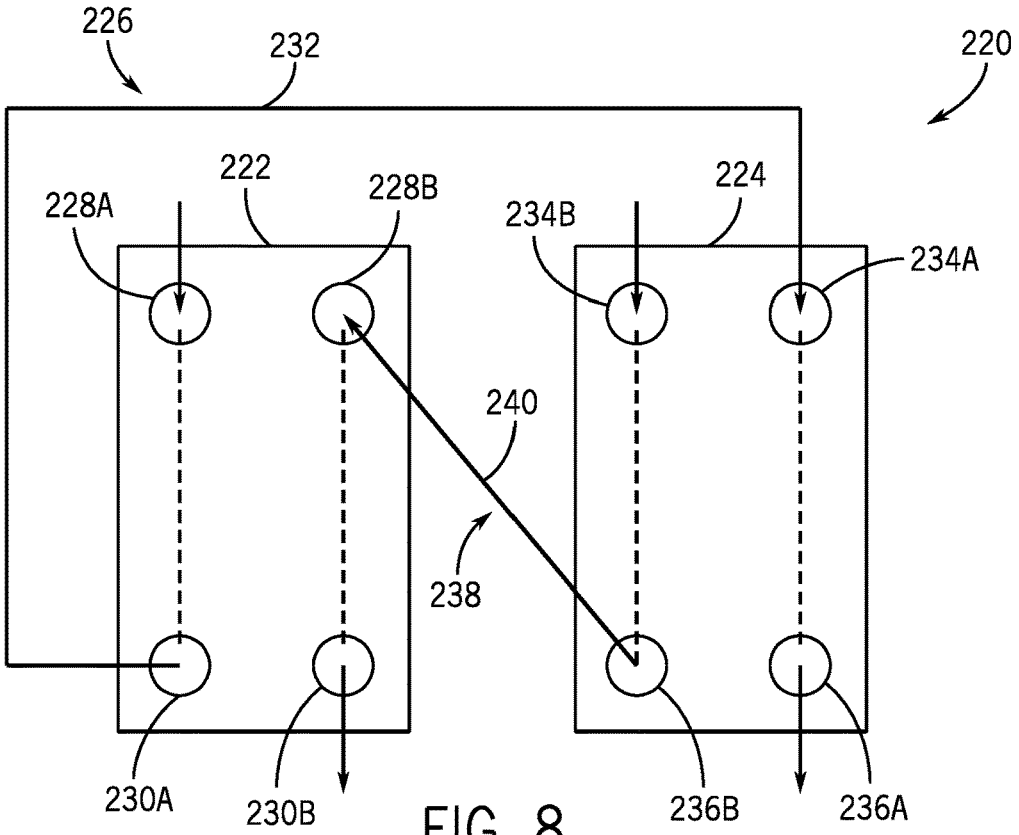
FIG. 8 is a diagrammatical representation of a dual-circuit condenser for use in a heat pump system configured to operate in multiple modes, in accordance with an embodiment of the present techniques.

FIGS. 7 and 8 illustrate two possible configurations of the condenser 36 that may be used in various embodiments of the heat pump 30. More specifically, FIG. 7 is a single-circuit configuration of the condenser 36, and FIG. 8 is a dual-circuit configuration of the condenser 36.

The condenser 36 of FIG. 7 may be a brazed-plate heat exchanger. The condenser 36 may, in some embodiments, be partially formed via a two-circuit, single pass heat exchanger 198 that is used instead as a one-circuit, dual pass heat exchanger. The heat exchanger 198 may include two internal refrigerant passes 200 formed therein, each pass 200 having an inlet 202 and an outlet 204. Water 206 may flow through an interior of the heat exchanger 198 as well, in order to receive heat from the compressed refrigerant flowing through the passes 200. The condenser 36 includes an external flow line 210 coupled between a first outlet 204A of the heat exchanger 198 and a second inlet 202B of the heat exchanger 198. The condenser 36 routes an incoming refrigerant flow 208 from a first inlet 202A of the heat exchanger 198 to the corresponding first outlet 204A, and the external flow line 210 routes the refrigerant from the first outlet 204A to the second inlet 202B. From here the refrigerant flows through the second pass 200 from the inlet 202B to a second outlet 204B where it exits toward the first expansion valve 74, as indicated by arrow 212.

Instead of two separate circuits of refrigerant flowing in parallel through the condenser 36, a single circuit of refrigerant makes the two passes 200 through the same condenser 36. This setup may allow for an increase in refrigerant velocity and, as a result, heat transfer through the condenser 36 without creating an excessive pressure drop on the water side of the condenser 36. By using two passes for greater heat transfer, this condenser 36 may weigh less than approximately 50% of the weight of a conventional single-circuit R410A condenser with a comparable heat exchanger performance.

FIG. 8 shows a similar configuration for a dual-circuit condenser 220 using two brazed plate heat exchangers 222 and 224. The piping arrangement allows for each of the circuits to flow through both heat exchangers 222 and 224. That is, a first circuit 226 enters the condenser 220 via a first inlet 228A of the first heat exchanger 222, flows to a corresponding first outlet 230A of the first heat exchanger 222, and flows through an external flow line 232 from the first outlet 230A to a first inlet 234A of the second heat exchanger 224. The refrigerant continues through the second heat exchanger 224 from the first inlet 234A to a corresponding first outlet 236A, where it exits the condenser 220. Similarly, a second circuit 238 of refrigerant is routed through the condenser 220 in the following manner. The refrigerant enters a second inlet 234B of the second heat exchanger 224, flows from the second inlet 234B to a corresponding second outlet 236B, flows from the second outlet 236B to a second inlet 228B of the first heat exchanger 222 via an external flow line 240, and flows from the second inlet 228B to a corresponding second outlet 230B.

It should be noted that other types and configurations of heat exchangers may be used by applying the above described techniques. For example, additional passes on the refrigerant side may be used in some embodiments. For passes where two-phase heat transfer is expected to occur, the heat exchanger may include a counter flow or parallel flow arrangement of the water and refrigerant through the heat exchanger, without affecting the heat exchanger performance. In some embodiments, series water side passes or multiple water side passes may be included. The above described multiple pass heat exchanger techniques are not limited to condenser applications. For example, the configurations may apply to evaporators (e.g., evaporator 40), heat exchangers with single phase heat transfer occurring on both the refrigerant and water side, and cascade heat exchangers, among others. Moreover, the above described heat exchanger techniques are not limited to use in heat pump applications. The techniques may be applied similarly within chiller systems, heat recovery systems, air conditioners, chemical processes, power plants, or any other application that may take advantage of additional pass options for plate heat exchangers.

Water Piping Configurations for the Heat Pump System

Figure 9:
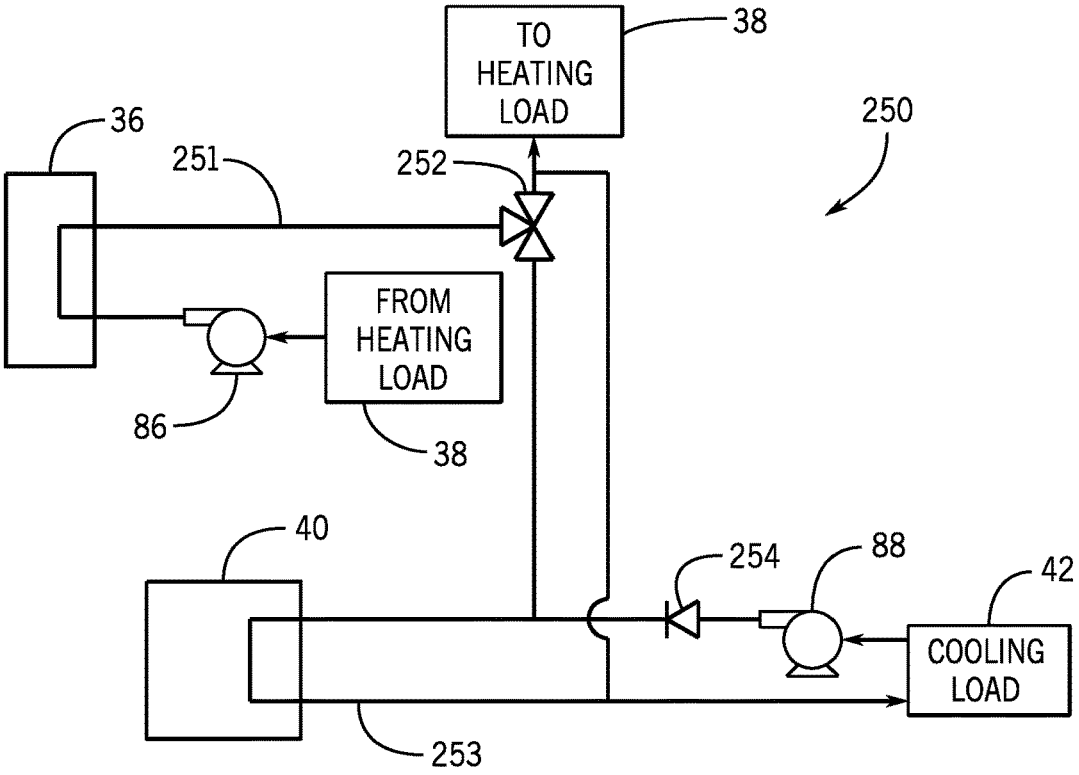
FIG. 9 is a diagrammatical representation of liquid piping used to supply liquid to a condenser and an evaporator of the heat pump systems of FIGS. 2-5, in accordance with an embodiment of the present techniques.
Figure 10:
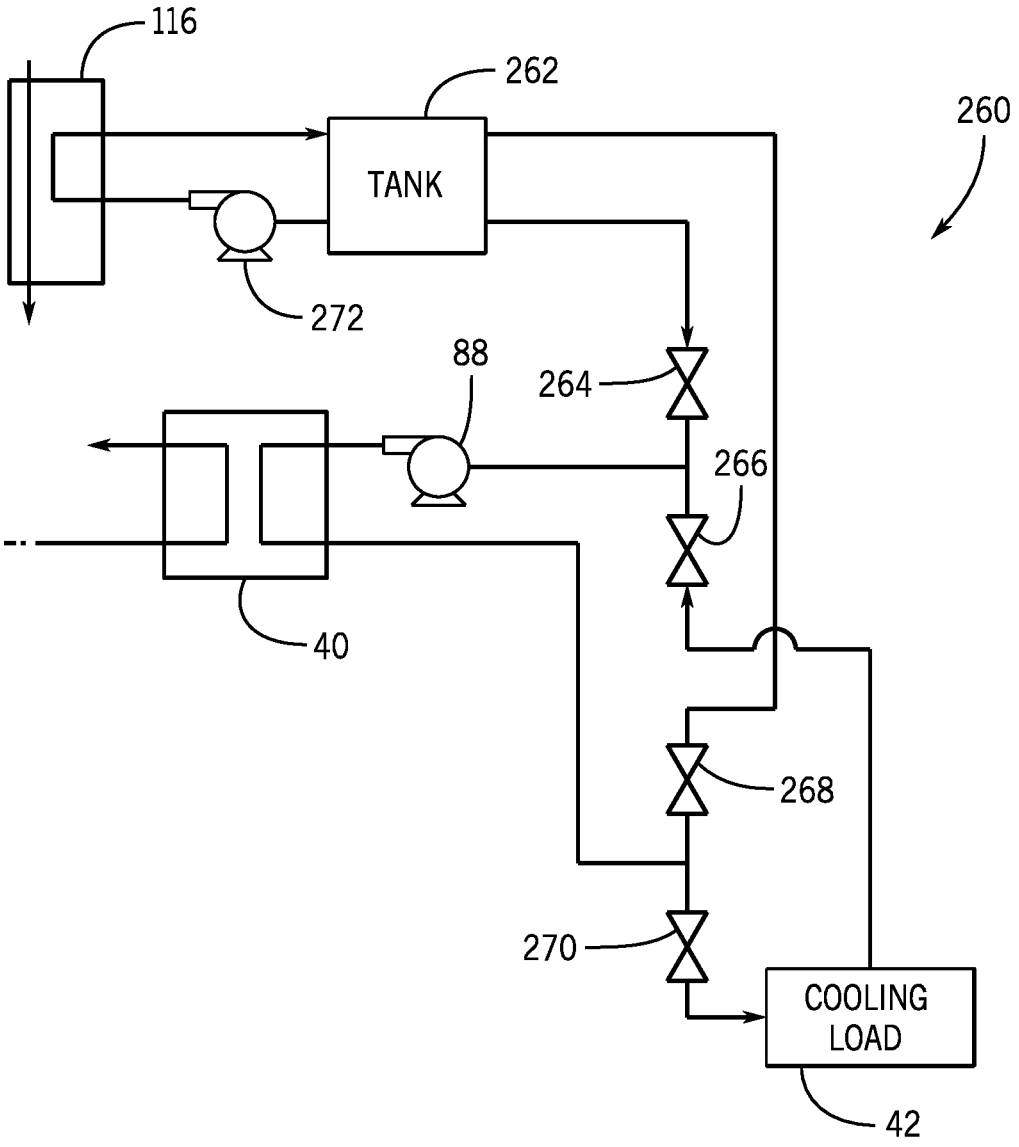
FIG. 10 is a diagrammatical representation of liquid piping used to provide thermal energy storage for the heat pump systems of FIGS. 3 and 5, in accordance with an embodiment of the present techniques.

FIGS. 9 and 10 illustrate embodiments of water piping systems that may be used in the context of the heat pump 30 system described above. The water piping systems may link the water piping systems associated with the heating load 38, the cooling load 42, and/or the subcooler 116 to increase efficiency of the heat pump 30 during certain operational modes.

FIG. 9 is an embodiment of a water piping system 250 that incorporates and extends between the heating load 38 and the cooling load 42 of the heat pump 30. This water piping system 250 may be used with any embodiment of the heat pump 30 described above with reference to FIGS. 2-5. The water piping system 250 may enable a supply of hot water to flow to the evaporator 40 during the "defrost" mode. The water piping system 250 may run between condenser water piping 251 that directs water between the pump 86, condenser 36, and heating load 38, and evaporator water piping 253 that directs water between the pump 88, evaporator 40, and cooling load 42. In the illustrated embodiment, the water piping system 250 may include a three-way valve 252 in the condenser water piping 251. The three-way valve 252 can be used to direct the condenser water pumped through the condenser 36 to the heating load 38, or to direct the warm condenser water from the heating load 38 to the evaporator water piping 253. A check valve 254 adjacent the pump 88 in the evaporator water piping 251 may help to direct the flow of heated water from the condenser water piping 251 to the evaporator 40 instead of to the pump 88. A return line 254 may route the warmed water from the evaporator 40 back to the heating load 38. The three-way valve 252 may be controlled (e.g., via controller 32) to route the warm condenser water to the evaporator 40 during "defrost" mode and to prevent an undesirable flow of water between the condenser water piping 251 and the evaporator water piping 253 during all other modes of operation.

Other piping configurations may be used to provide the warm water to the evaporator 40 during the "defrost" mode in other embodiments. For example, some embodiments may utilize a three-way valve in a different location relative to the condenser water piping 251 and the evaporator water piping 253. Other embodiments may include one or more two-way valves, a dedicated pump, check valves, or some combination thereof, used to direct water between the condenser water piping 251 and the evaporator water piping 253 as desired.

FIG. 10 is an embodiment of a water piping system 260 that incorporates and extends between the water-cooled subcooler 116 and the evaporator 40. This water piping system 260 may be used with an embodiment of the heat pump 30 that includes a water-cooled subcooler 116, such as those described above with reference to FIGS. 3 and 5. The water piping system 260 may provide thermal energy storage and a source of warm water for defrost operations or additional heating capacity. To that end, the water piping system 260 includes a water tank 262 for providing cooled water to the subcooler 116, and four valves 264, 266, 268, and 270 disposed along flow lines between the tank 262, the evaporator 40, and the cooling load 42.

The illustrated water piping system 260 may be controlled (e.g., via controller 32) to provide water to the evaporator 40, the tank 262, and/or the subcooler 116 when the heat pump 30 is operating in certain modes and at certain times of the day. That is, based on the operating mode of the heat pump 30 and the time of day or measured ambient air temperature, the controller 32 may actuate the valves 264, 266, 268, and 270, the evaporator pump 88, and a subcooler pump 272 to transfer heat in a desired manner throughout the water piping system 260. When the heat pump 30 is operating in a cooling mode (e.g., "cooling only" or "cooling with heat recovery") during the heat of the day, for example, the first valve 264 and the third valve 268 are closed, the second valve 266 and the fourth valve 270 are open, and both the pumps 88 and 272 are on. In this mode, the pump 88 may move water through the evaporator 40 to provide cooled water to the cooling load 42. Simultaneously, the pump 272 may move cold water from the bottom of the tank 262 to the subcooler 116, in order to provide additional cooling to the refrigerant flowing through the subcooler 116.

When the heat pump 30 is operating in the cooling mode at night or during times of off-peak cooling demand, the first valve 264 and the third valve 268 are open, the second valve 266 and the fourth valve 270 are closed, the pump 88 is on, and the pump 272 is off. In this mode, the refrigerant flowing through the evaporator 40 cools water that is pumped therethrough via the pump 88 and provided to the tank 262. This allows the heat pump 30 to operate in the cooling mode while cooling the water stored in the tank 262. This cooled water stored in the tank 262 may then be used to provide additional cooling via the subcooler 116, as described above, during the heat of the day.

When the heat pump 30 is operating in a heating mode (e.g., "heating only" or "heating with limited cooling"), the valves 264, 266, 268, and 270 are all closed, the pump 88 is off, and the pump 272 is on. In this mode, the pump 272 moves the water through the subcooler 116, where it is heated by the refrigerant flowing therethrough and provided back to the tank 262. This may be used to warm the water stored in the tank 262 when it is cold outside. Then, the tank 262 may be used as a heat source for the heat pump 30 when the heat pump 30 is operating in the "defrost" mode. To that end, in "defrost" mode, the first valve 264 and the third valve 268 are open, the second valve 266 and the fourth valve 270 are closed, the pump 88 is on, and the pump 272 is off. Thus, the pump 88 moves the heated water from the tank 262 into the evaporator 40 to help defrost the evaporator 40. This control of the water piping system 260 may also be used when the heat pump 30 is operating in the "100% heat recovery" mode, in order to increase the heating capacity of the refrigerant cycle.

Heat Pump System with Reversing Valve

Figure 11:
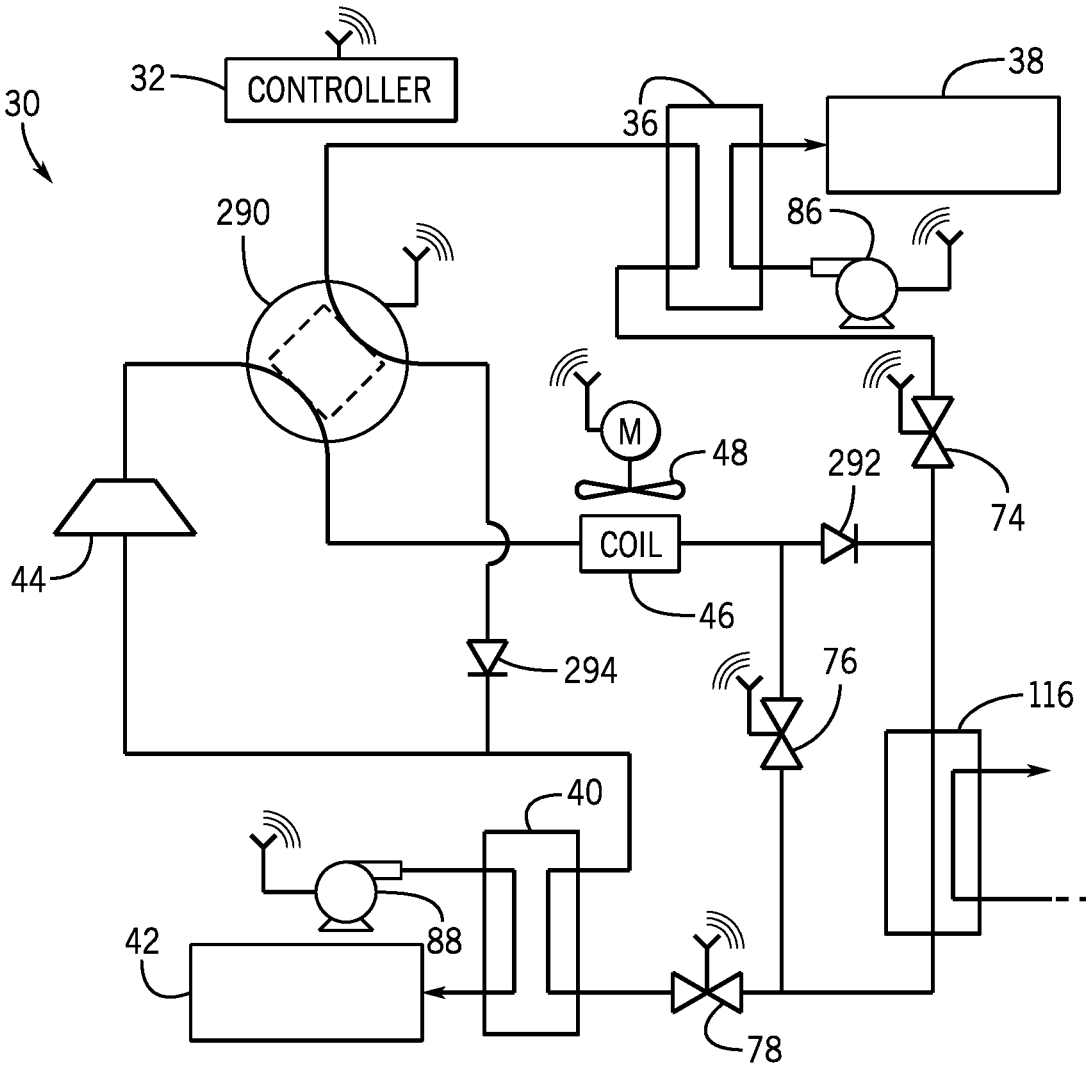
FIG. 11 is a diagrammatical representation of a heat pump system configured to operate in multiple modes, in accordance with an embodiment of the present techniques.

There may be other configurations of heat pump systems that are capable of operating in various heating and cooling modes. For example, some embodiments of the heat pump 30 may include a reversing valve 290, as illustrated in FIG. 11. In this illustrated embodiment, the reversing valve 290 is disposed at the discharge of the compressor system 44. The reversing valve 290 is configured to direct the refrigerant in two different directions, depending on the position of the reversing valve 290. For example, the illustrated reversing valve 290 includes solid lines that represent the flow of refrigerant in a first valve setting and dashed lines that represent the flow of refrigerant in a second valve setting. In the first valve setting, the reversing valve 290 may direct compressed refrigerant from the compressor 44 to the coil 46, while in the second valve setting, the reversing valve 290 may direct the compressed refrigerant to the condenser 36.

As discussed above, the controller 32 may be configured to regulate (e.g., automatically) operation of the reversible valve 290 and the expansion valves 74, 76, and 78 in response to feedback measured by the sensors or received as user inputs to the controller 32. In other embodiments, the reversible valve 290 and the expansion valves 74, 76, and 78 may be operated manually. Additionally, the controller 32 may control other processes of the heat pump 30, such as operation of the pumps 86 and 88 that pump heating or cooling fluid through the condenser 36 and the evaporator 40, respectively, operation and speed of the fan 48, and so forth. The different operational modes and corresponding controls are outline in Table 3 below.

TABLE 3

Heat pump modes of operation for reversing valve heat pump

| Mode | Reversing valve | EEV1 | EEV2 | EEV3 | Fan | Cond. Pump | Evap. Pump |
|---|---|---|---|---|---|---|---|
| Cooling only | To Coil | Closed | Closed | Modulate | On | Off | On |
| 100% heat recovery | To HX | Open | Closed | Modulate | Off | On | On |
| Heating only | To HX | Open | Modulate | Closed | On | On | Off |
| Defrost | To Coil | Closed | Open | Modulate | Off | Off | On |

It should be noted that the illustrated heat pump 30 may enable fewer modes of operation than the earlier described heat pump embodiments. However, this type of heat pump 30 may be desirable for use in smaller HVAC&R systems, because it utilizes less piping and fewer valves to control.

In the "cooling only" mode, the reversible valve 290 is set to provide compressed refrigerant from the compressor system 44 to the coil 46. The first and second expansion valves 74 and 76 are closed, while the third expansion valve 78 modulates. In addition, the fan 48 is on, the condenser pump 86 is off, and the evaporator pump 88 is on. In this mode, the compressed refrigerant is directed to and flows through the coil 46, where the fan 48 blows ambient air over the coil 46 to cool and condense the refrigerant to a liquid. Since the first and second expansion valves 74 and 76 are closed, the condensed refrigerant exits the coil 46 and flows through a check valve 292, the subcooler 116, and the third expansion valve 78. Liquid refrigerant flashes after the third expansion valve 78 to produce a two-phase flow of refrigerant, and the third expansion valve 78 is modulated to supply the two-phase refrigerant to the evaporator 40. As the evaporator pump 88 pumps fluid through the evaporator 40, heat transfers from the fluid to the expanded refrigerant. This cools the fluid, which is provided to the cooling load 42. The evaporator 40 boils the liquid refrigerant, and the vaporized refrigerant flows back to the compressor system 44.

In the "100% heat recovery" mode, the reversible valve 290 is set to provide compressed refrigerant from the compressor system 44 to the condenser 36. The first expansion valve 74 is open, the second expansion valve 76 is closed, and the third expansion valve 78 modulates. In addition, the fan 48 is off, the condenser pump 86 is on, and the evaporator pump 88 is on. The full discharge flow of compressed refrigerant from the compressor system 44 may flow through the condenser 36. As the condenser pump 86 pushes fluid through the condenser 36, the fluid absorbs heat from the refrigerant flowing through the condenser 36 to produce a heated fluid that is directed to the heating load 38. From the condenser 36, the refrigerant then travels through the open first expansion valve 74. Since the second expansion valve 76 is closed, the expanded refrigerant flows through the subcooler 116 and to the third expansion valve 78. The third expansion valve 78 flashes the refrigerant into two phases and modulates the flow of the two-phase refrigerant into the evaporator 40. The evaporator 40 boils the liquid refrigerant, and vaporized refrigerant exits the evaporator 40 and flows back to the compressor system 44.

In the "heating only" mode, the reversing valve 290 is set to provide compressed refrigerant from the compressor system 44 to the condenser 36. The first expansion valve 74 is open, the second expansion valve 76 modulates, and the third expansion valve 78 is closed. In addition, the fan 48 is on, the condenser pump 86 is on, and the evaporator pump 88 is off. In this mode, the compressed refrigerant flows from the compressor system 44 to the condenser 36 and not to the coil 46. As the condenser pump 86 pushes fluid through the condenser 36, the fluid absorbs heat from the refrigerant flowing through the condenser 36 to produce a heated fluid that is directed to the heating load 38. From the condenser 36, the refrigerant then travels through the open first expansion valve 74. The third expansion valve 78 is closed in this mode to prevent the condensed refrigerant from flowing into the evaporator 40. As a result, the condensed refrigerant flows through the subcooler 116 and into the second expansion valve 76, which may be modulated to supply the refrigerant to the coil 46. The check valve 292 may keep the refrigerant from flowing directly from the first expansion valve 74 to the coil 46. In this mode, the coil 46 acts as an evaporator to transfer heat from the air to the refrigerant, thereby heating the refrigerant for use in the condenser 36. The fan 48 operates generally at full capacity in this operating mode to move air across the coil 46. The refrigerant may exit the coil 46 and return to the compressor system 44 via the reversing valve 290 and a check valve 294.

In the "defrost" mode, the reversing valve 290 is set to provide compressed refrigerant from the compressor system 44 to the coil 46. The first expansion valve 74 is closed, the second expansion valve 76 is open, and the third expansion valve 78 modulates. In addition, the fan 48 is off, the condenser pump 86 is off, and the evaporator pump 88 is on. In this mode, compressed refrigerant flows from the compressor system 44 through the coil 46, where it provides heat to defrost the coil 46. The refrigerant exits the coil 46 and flows through open second expansion valve 76 toward the third expansion valve 78. In the defrost mode, the third expansion valve 78 is modulated to supply the liquid refrigerant to the evaporator 40. Relatively hot water is pumped via the pump 88 into the evaporator 40 in order to boil the liquid refrigerant flowing through the evaporator 40, and the vaporized refrigerant flows back to the compressor system 44.

Figure 12:
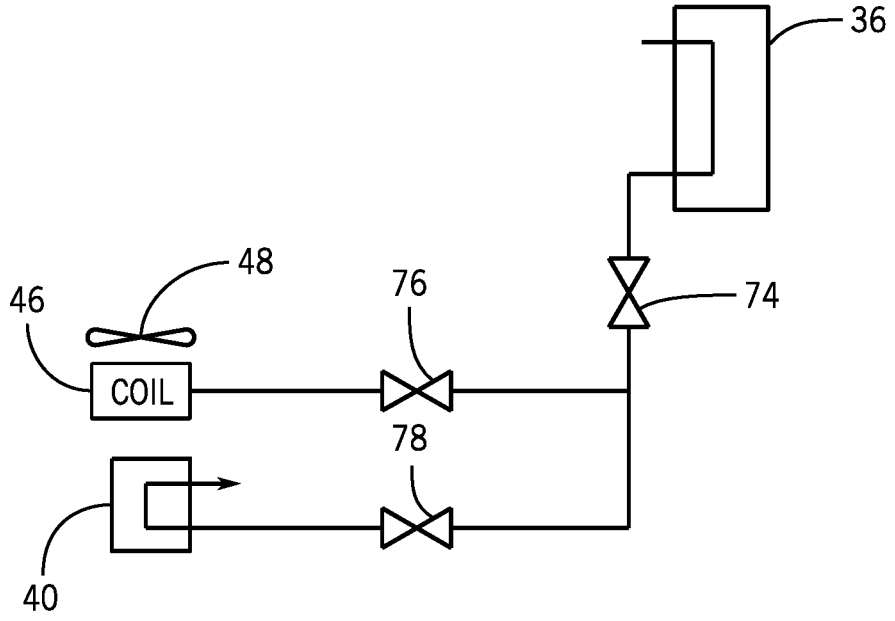
FIG. 12 is a diagrammatical representation of portions of a heat pump system configured to operate in multiple modes, in accordance with an embodiment of the present techniques.

It should be noted that the subcooler 116 illustrated in FIG. 11 is an optional component. FIG. 12 illustrates another arrangement of components that may be used in the heat pump 30 of FIG. 11. That is, the illustrated embodiment shows an arrangement of the condenser 36, the coil 46, the evaporator 40, and the expansion valves 74, 76, and 78 without the subcooler 116 or the check valve 292 disposed therebetween. In this embodiment, the control schemes would be generally the same as those outlined in Table 3 above. However, in the cooling only mode, the second expansion valve 76 would be open instead of closed, since there is no check valve 292 to allow a flow of liquid refrigerant around the second expansion valve 76. In still further embodiments, a combination of the embodiments described in FIGS. 11 and 12 may be utilized to form a heat pump 30 that is operable in several different heating/cooling modes. In addition, other combinations of the various embodiments described above with reference to FIGS. 2-12 may be combined in different arrangements to meet the heating, cooling, heat recovery, defrost, or other demands on the heat pump 30.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A refrigeration system, comprising:

a compressor configured to circulate a refrigerant through a refrigerant circuit;

an evaporator disposed along the refrigerant circuit and configured to place the refrigerant in thermal communication with a first fluid stream;

a condenser disposed along the refrigerant circuit and configured to place the refrigerant in thermal communication with a second fluid stream;

an outdoor coil disposed along the refrigerant circuit and configured to receive the refrigerant from the condenser or from the compressor, wherein that the outdoor coil is configured to place the refrigerant in thermal communication with an air flow;

a first valve configured to adjust a first flow of the refrigerant from the compressor toward the outdoor coil;

a second valve configured to adjust a second flow of the refrigerant from the outdoor coil toward the compressor;

one or more expansion valves disposed along the refrigerant circuit and configured to adjust a flow of the refrigerant through the outdoor coil, the condenser, and/or the evaporator; and a controller comprising one or more tangible, non-transitory machine-readable media comprising processor-executable instructions to:

receive feedback indicative of a heating set point, a cooling set point, a first temperature of the first fluid stream, a second temperature of the second fluid stream, and a third temperature of ambient air;

determine a mode of operation of the refrigeration system based on the feedback; and adjust a position of the first valve, or the second valve, or the one or more expansion valves, or a combination thereof, based on the mode of operation of the refrigeration system, wherein:

the controller is configured to select a "cooling only" mode as the mode of operation when the cooling set point is lower than the first temperature of the first fluid stream and when the heating set point is less than or equal to the second temperature of the second fluid stream, the controller is configured to select a "100% heat recovery" mode as the mode of operation when a first temperature differential between the first temperature of the first fluid and the cooling set point exceeds a differential threshold value and when a second temperature differential between the heating set point and the second temperature of the second fluid stream exceeds the differential threshold value, the controller is configured to select a "cooling plus heat recovery" mode as the mode of operation when the cooling set point is less than the first temperature of the first fluid stream by a first threshold amount and when the heating set point is greater than the second temperature of the second fluid stream by a second threshold amount, less than the first threshold amount, the controller is configured to select a "heating only" mode as the mode of operation when the cooling set point is greater than or equal to the first temperature of the first fluid stream and when the heating set point is greater than the second temperature of the second fluid stream, the controller is configured to select a "heating plus limited cooling" mode as the mode of operation when the cooling set point is less than the first temperature of the first fluid stream by a third threshold amount and when the heating set point is greater than the second temperature of the second fluid stream by a fourth threshold amount, greater than the third threshold amount, or any combination thereof.

2. The refrigeration system of claim 1, wherein the controller is configured to select the "cooling only" mode as the mode of operation when the cooling set point is lower than the first temperature of the first fluid stream and when the heating set point is less than or equal to the second temperature of the second fluid stream, and the controller further is configured to adjust the first valve toward an open position, adjust the second valve toward a closed position, and adjust the one or more expansion valves to enable the refrigerant to bypass the condenser and flow through the outdoor coil in the "cooling only" mode.

3. The refrigeration system of claim 1, wherein the controller is configured to select the "heating only" mode as the mode of operation when the cooling set point is greater than or equal to the first temperature of the first fluid stream and when the heating set point is greater than the second temperature of the second fluid stream, and the controller is further configured to adjust the first valve toward a closed position, adjust the second valve toward an open position, and adjust the one or more expansion valves to enable the refrigerant to bypass the evaporator and flow from the condenser toward the outdoor coil in the "heating only" mode.

4. The refrigeration system of claim 1, wherein the controller is configured to select a "defrost" mode as the mode of operation when the third temperature of ambient air is below a threshold outdoor temperature.

5. One or more tangible, non-transitory machine-readable media comprising processor-executable instructions to:

receive feedback indicative of a heating set point of a heating load, a cooling set point of a cooling load, a first temperature of a first fluid stream in thermal communication with the cooling load, a second temperature of a second fluid stream in thermal communication with the heating load, and a third temperature of ambient air;

determine a mode of operation of a refrigeration system based on the feedback, wherein the refrigeration system comprises:

a compressor configured to circulate a refrigerant through a refrigerant circuit;

an evaporator configured to place the refrigerant in thermal communication with the first fluid stream;

a condenser configured to place the refrigerant in thermal communication with the second fluid stream;

an outdoor coil configured to receive the refrigerant from the condenser or from the compressor, wherein that the outdoor coil is configured to place the refrigerant in thermal communication with an air flow;

a first valve configured to adjust a first flow of the refrigerant from the compressor toward the outdoor coil;

a second valve configured to adjust a second flow of the refrigerant from the outdoor coil toward the compressor;

one or more expansion valves configured to adjust a flow of the refrigerant through the outdoor coil, the condenser, and/or the evaporator; and adjust a position of the first valve, or the second valve, or the one or more expansion valves, or a combination thereof, based on the mode of operation of the refrigeration system, wherein the processor-executable instructions are configured to:

select a "cooling only" mode as the mode of operation when the cooling set point is lower than the first temperature of the first fluid stream and when the heating set point is less than or equal to the second temperature of the second fluid stream, select a "100% heat recovery" mode as the mode of operation when a first temperature differential between the first temperature of the first fluid and the cooling set point exceeds a differential threshold value and when a second temperature differential between the heating set point and the second temperature of the second fluid stream exceeds the differential threshold value, select a "cooling plus heat recovery" mode as the mode of operation when the cooling set point is less than the first temperature of the first fluid stream by a first threshold amount and when the heating set point is greater than the second temperature of the second fluid stream by a second threshold amount, less than the first threshold amount, select a "heating only" mode as the mode of operation when the cooling set point is greater than or equal to the first temperature of the first fluid stream and when the heating set point is greater than the second temperature of the second fluid stream, select a "heating plus limited cooling" mode as the mode of operation when the cooling set point is less than the first temperature of the first fluid stream by a third threshold amount and when the heating set point is greater than the second temperature of the second fluid stream by a fourth threshold amount, greater than the third threshold amount, or any combination thereof.

6. The one or more tangible, non-transitory machine-readable media of claim 5, wherein the processor-executable instructions are configured to select a "defrost" mode as the mode of operation when the third temperature of ambient air is below a threshold outdoor temperature.

7. A method, comprising:

receiving feedback indicative of a heating set point of a heating load, a cooling set point of a cooling load, a first temperature of a first fluid stream in thermal communication with the cooling load, a second temperature of a second fluid stream in thermal communication with the heating load and a third temperature of ambient air;

determining a mode of operation of a refrigeration system based on the feedback, wherein the refrigeration system comprises:

a compressor configured to circulate a refrigerant through a refrigerant circuit;

an evaporator configured to place the refrigerant in thermal communication with the first fluid stream;

a condenser configured to place the refrigerant in thermal communication with the second fluid stream;

an outdoor coil configured to receive the refrigerant from the condenser or from the compressor, wherein that the outdoor coil is configured to place the refrigerant in thermal communication with an air flow;

a first valve configured to adjust a first flow of the refrigerant from the compressor toward the outdoor coil;

a second valve configured to adjust a second flow of the refrigerant from the outdoor coil toward the compressor; and one or more expansion valves configured to adjust a flow of the refrigerant through the outdoor coil, the condenser, and/or the evaporator;

adjusting a position of the first valve, or the second valve, or the one or more expansion valves, or a combination thereof, based on the mode of operation of the refrigeration system, wherein determining the mode of operation of the refrigeration system based on the feedback comprises:

determining a "cooling only" mode as the mode of operation when the cooling set point is lower than the first temperature of the first fluid stream and when the heating set point is less than or equal to the second temperature of the second fluid stream, determining a "100% heat recovery" mode as the mode of operation when a first temperature differential between the first temperature of the first fluid and the cooling set point exceeds a differential threshold value and when a second temperature differential between the heating set point and the second temperature of the second fluid stream exceeds the differential threshold value, determining a "cooling plus heat recovery" mode as the mode of operation when the cooling set point is less than the first temperature of the first fluid stream by a first threshold amount and when the heating set point is greater than the second temperature of the second fluid stream by a second threshold amount, less than the first threshold amount, determining a "heating only" mode as the mode of operation when the cooling set point is greater than or equal to the first temperature of the first fluid stream and when the heating set point is greater than the second temperature of the second fluid stream, determining a "heating plus limited cooling" mode as the mode of operation when the cooling set point is less than the first temperature of the first fluid stream by a third threshold amount and when the heating set point is greater than the second temperature of the second fluid stream by a fourth threshold amount, greater than the third threshold amount, or any combination thereof.

8. The method of claim 7, comprising adjusting the first valve toward an open position, adjusting the second valve toward a closed position, and adjusting the one or more expansion valves to enable the refrigerant to bypass the condenser and flow through the outdoor coil when the mode of operation is determined to be the "cooling only" mode.

9. The method of claim 7, comprising adjusting the first valve toward a closed position, adjusting the second valve toward an open position, and adjusting the one or more expansion valves to enable the refrigerant to bypass the evaporator and flow from the condenser toward the outdoor coil when the mode operation is determined to be the "heating only" mode.

10. The method of claim 7, comprising adjusting the first valve toward a first closed position, adjusting the second valve toward a second closed position, and adjusting the one or more expansion valves to block a third flow of the refrigerant toward the outdoor coil when the mode of operation is determined to be the "100% heat recovery" mode.

* * * * *